US011287134B2

(12) United States Patent
Berry

(10) Patent No.: US 11,287,134 B2
(45) Date of Patent: Mar. 29, 2022

(54) COMBUSTOR WITH DUAL PRESSURE PREMIXING NOZZLES

(71) Applicant: General Electric Company, Schenectady, NY (US)

(72) Inventor: Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 16/731,207

(22) Filed: Dec. 31, 2019

(65) Prior Publication Data

US 2021/0199298 A1 Jul. 1, 2021

(51) Int. Cl.
*F23R 3/34* (2006.01)
*F23R 3/10* (2006.01)
(Continued)

(52) U.S. Cl.
CPC ..... *F23R 3/346* (2013.01); *F23R 3/10* (2013.01); *F23R 3/26* (2013.01); *F23R 3/286* (2013.01); *F23R 3/36* (2013.01); *F23R 3/005* (2013.01)

(58) Field of Classification Search
CPC .... F23R 3/005; F23R 3/10; F23R 3/26; F23R 3/286; F23R 3/34; F23R 3/343; F23R 3/346; F23R 3/36
See application file for complete search history.

(56) References Cited

U.S. PATENT DOCUMENTS 3,872,664 A * 3/1975 Lohmann ..... F23R 3/346 60/746
4,192,139 A 3/1980 Buchheim
(Continued)

FOREIGN PATENT DOCUMENTS

CN 113124421 A 7/2021
EP 2039418 A1 3/2009
(Continued)

OTHER PUBLICATIONS

Extended European Search Report and Opinion issued in connection with corresponding EP Application No. 20204208.1 dated Apr. 14, 2021, 10 pages.
(Continued)

*Primary Examiner* — William H Rodriguez
(74) *Attorney, Agent, or Firm* — Charlotte Wilson; Hoffman Warnick LLC

(57) ABSTRACT

A combustor may include a combustor liner and flow sleeve. A high pressure air cools an outer surface of the combustor liner via openings in the flow sleeve, creating a lower pressure air in an annulus between the combustor liner and the flow sleeve. A first fuel nozzle is positioned at a primary combustion zone, and a second fuel nozzle is positioned at a secondary combustion zone of the liner. A fuel source is configured to deliver a fuel to the fuel nozzles. The fuel nozzles produce a premixture of high pressure air and the fuel, and produce a mixture of the premixture and the lower pressure air, prior to introducing the mixture to a respective primary or secondary combustion zone of the combustor. The combustor provides improved fuel premixing and is fuel flexible, and reduces pressure drop requirements. The combustor is usable in a can, annular, or segmented annular combustor assembly.

29 Claims, 13 Drawing Sheets

(51) Int. Cl.

| | |
|---|---|
| ***F23R 3/26*** | (2006.01) |
| ***F23R 3/28*** | (2006.01) |
| ***F23R 3/36*** | (2006.01) |
| *F23R 3/00* | (2006.01) |

(56) References Cited

U.S. PATENT DOCUMENTS

| | | | | |
|---|---|---|---|---|
| 5,630,320 | A * | 5/1997 | Matsuda | F23R 3/18 60/749 |
| 5,802,854 | A * | 9/1998 | Maeda | F23R 3/346 60/737 |
| 5,836,164 | A * | 11/1998 | Tsukahara | F23C 6/047 60/733 |
| 8,281,596 | B1 | 10/2012 | Rohrssen et al. | |
| 8,418,468 | B2 | 4/2013 | McMahan et al. | |
| 9,212,609 | B2 | 12/2015 | Twardochleb et al. | |
| 10,502,426 | B2 * | 12/2019 | Lemon | F23R 3/286 |
| 2009/0113893 | A1 | 5/2009 | Li et al. | |
| 2009/0223228 | A1 * | 9/2009 | Romoser | F02C 9/263 60/776 |
| 2010/0248171 | A1 * | 9/2010 | Hayashi | F23R 3/286 431/196 |
| 2011/0167828 | A1 * | 7/2011 | Singh | F23C 9/00 60/740 |
| 2013/0025285 | A1 * | 1/2013 | Stewart | F02C 7/2365 60/740 |
| 2013/0086912 | A1 * | 4/2013 | Berry | F23R 3/286 60/746 |
| 2013/0299602 | A1 * | 11/2013 | Hughes | F23R 3/045 239/8 |
| 2013/0305725 | A1 * | 11/2013 | Berry | F23R 3/14 60/746 |
| 2013/0305739 | A1 * | 11/2013 | Berry | F23R 3/283 60/785 |
| 2014/0260269 | A1 | 9/2014 | Davis, Jr. et al. | |
| 2014/0260279 | A1 * | 9/2014 | DiCintio | F23R 3/005 60/752 |
| 2015/0027126 | A1 * | 1/2015 | Berry | F02C 7/224 60/739 |
| 2015/0167983 | A1 * | 6/2015 | McConnaughhay | F23R 3/286 60/726 |
| 2016/0223202 | A1 * | 8/2016 | Borchert | F23R 3/10 |
| 2017/0038074 | A1 * | 2/2017 | Myers | F23R 3/343 |
| 2017/0175634 | A1 * | 6/2017 | Hughes | F23R 3/06 |
| 2017/0175635 | A1 * | 6/2017 | Hughes | F23R 3/346 |
| 2017/0175636 | A1 * | 6/2017 | Hughes | F23R 3/002 |
| 2017/0175637 | A1 * | 6/2017 | Hughes | F01D 9/023 |
| 2017/0176013 | A1 * | 6/2017 | Hughes | F02C 7/222 |
| 2017/0176014 | A1 * | 6/2017 | Hughes | F01D 5/187 |
| 2017/0191668 | A1 * | 7/2017 | Hughes | F02C 7/222 |
| 2017/0276360 | A1 | 9/2017 | Berry et al. | |
| 2017/0276369 | A1 | 9/2017 | Berry et al. | |
| 2017/0284671 | A1 * | 10/2017 | Asai | F23N 5/107 |
| 2017/0298817 | A1 * | 10/2017 | Horiuchi | F02C 7/16 |
| 2018/0187607 | A1 * | 7/2018 | Hughes | F23R 3/346 |
| 2018/0187894 | A1 * | 7/2018 | Cai | F23R 3/286 |
| 2018/0328587 | A1 * | 11/2018 | Gubba | F23R 3/10 |
| 2018/0328588 | A1 * | 11/2018 | Lemon | F23R 3/36 |
| 2019/0072279 | A1 * | 3/2019 | Natarajan | F02C 7/222 |
| 2019/0178496 | A1 * | 6/2019 | Jones | F23R 3/002 |
| 2019/0178497 | A1 * | 6/2019 | Jones | F23R 3/002 |
| 2019/0178498 | A1 * | 6/2019 | Wilson | F23R 3/346 |
| 2021/0095599 | A1 * | 4/2021 | Asai | F23R 3/346 |
| 2021/0095849 | A1 * | 4/2021 | Asai | F23R 3/46 |
| 2021/0095850 | A1 * | 4/2021 | Asai | F23R 3/343 |

FOREIGN PATENT DOCUMENTS

| | | | |
|---|---|---|---|
| EP | 2639508 | A2 | 9/2013 |
| EP | 3037729 | A1 | 6/2016 |
| EP | 3845812 | A1 | 7/2021 |
| WO | 030084867 | A1 | 10/2003 |

OTHER PUBLICATIONS

Notice of Publication issued in connection with corresponding EP Application No. 20204212.3, dated Jun. 9, 2021, 2 pages.

Notice of Publication issued in connection with corresponding CN Application No. 202011219568.4, dated Jul. 22, 2021, 1 page.

* cited by examiner

COMBUSTOR WITH DUAL PRESSURE PREMIXING NOZZLES

STATEMENT REGARDING GOVERNMENT FUNDING

This application was made with government support under contract number DE-FE0023965 awarded by the Department of Energy. The US government has certain rights in the invention.

CROSS-REFERENCE TO RELATED APPLICATIONS

This application relates to co-pending U.S. patent application Ser. Nos. 16/731,283 and 16/731,306, respectively entitled "Fluid Mixing Apparatus Using High- and Low-Pressure Fluid Streams," and "Fluid Mixing Apparatus Using Liquid Fuel and High- and Low-Pressure Fluid Streams,", filed concurrently herewith, and incorporated by reference herein.

TECHNICAL FIELD

The disclosure relates generally to gas turbine systems, and more particularly, to a head end assembly for a combustor of a gas turbine (GT) system, which includes fuel nozzles that mix fuel with air of two different pressures. The GT system may include a two-stage combustion section. In one embodiment, a dual-pressure premixing nozzle assembly may introduce a fuel/air mixture as part of a primary, header combustion zone and part of a secondary, axially staged fuel combustion zone.

BACKGROUND

Gas turbine (GT) systems are used in a wide variety of applications to generate power. In operation of a GT system, air flows through a compressor, and the compressed air is supplied to a combustion section. Specifically, the compressed air is supplied to a number of combustors, each having a number of fuel nozzles, which use the air in a combustion process with a fuel to produce a combustion gas stream. The compressor includes a number of inlet guide vanes (IGVs), the angle of which can be controlled to control an air flow to the combustion section. The combustion section is in flow communication with a turbine section in which the combustion gas stream's kinetic and thermal energy is converted to mechanical rotational energy. The turbine section includes a turbine that rotatably couples to and drives a rotor. The compressor may also rotatably couple to the rotor. The rotor may drive a load, like an electric generator.

The combustion section includes one or more combustors that can be used to control the load of the GT system, e.g., in a plurality of circumferentially spaced combustor 'cans', a conventional annular combustor, or a segmented annular combustor. Advancements in can-annular combustors have led to the use of two axially separated combustion zones. A header (or head end) combustion zone may be positioned at an upstream end of the combustion region of each combustor. The header combustion zone includes a number of fuel nozzles that introduce fuel for combustion. Advanced gas turbine systems also include a second combustion zone, which may be referred to as an axial fuel staging (AFS) combustion zone, downstream from the header combustion zone in the combustion region of each can-annular combustor. The AFS combustion zone includes a number of fuel nozzles or injectors that introduce fuel diverted (split) from the header combustion zone for combustion in the AFS combustion zone. The AFS combustion zone provides increased efficiency and assists in emissions compliance for the GT system by ensuring a higher efficacy of combustion that reduces harmful emissions in an exhaust of the GT system.

One challenge with advanced gas turbine systems operating at extremely high temperatures is achieving adequate cooling of combustion materials while simultaneously achieving low emissions. Higher temperature operation requires premixing of fuel and air to achieve emissions targets. To achieve the targeted emissions, the combustion residence time is ideally minimized by reducing the size of the combustion region. In contrast, enhancing the premixing process typically includes adding mixing length to the combustor.

In some circumstances, it may be desirable to burn liquid fuel instead of, or in addition to, gaseous fuel. The introduction of liquid fuel requires care to prevent coking of the liquid fuel nozzles and to prevent the liquid fuel from wetting the adjacent walls, which can contribute to coking along the walls. Such wall coking can lead to undesirable temperature increases in the combustor liner, which may shorten the service life of the liner.

BRIEF DESCRIPTION

A first aspect of the disclosure provides a combustor for a gas turbine (GT) system, the combustor comprising: a combustor liner defining a combustion region including a primary combustion zone and a secondary combustion zone downstream from the primary combustion zone; a flow sleeve surrounding at least part of the combustor liner, the flow sleeve including a plurality of cooling openings therein to: direct a flow of first air at a first pressure from a first air source to cool an outer surface of the combustor liner, and create a flow of second air at a second, lower pressure than the first pressure in an annulus between the combustor liner and the flow sleeve; a first fuel nozzle positioned at the primary combustion zone; a second fuel nozzle positioned at the secondary combustion zone; and a fuel source configured to deliver a first fuel to each of the first and second fuel nozzles, wherein the first and second fuel nozzles produce a premixture of the first air flow and the first fuel, and produce a mixture of the premixture and the second air flow, prior to introducing the mixture to a respective primary or secondary combustion zone.

A second aspect of the disclosure provides a head end assembly for a combustor of a gas turbine (GT) system, the head end assembly comprising: a first wall defining a first plenum in fluid communication with a source of a first air at a first pressure; and a plurality of fuel nozzles extending through the first plenum, each fuel nozzle including: a first annular wall defining: an inlet at a first side of the first plenum, the inlet open to a source of a second air at a second pressure; an outlet open to a combustion region of the combustor at a second side of the first plenum; and a first passage extending between the inlet and the outlet, wherein the first pressure is greater than the second pressure; a second plenum in fluid communication with a fuel source, wherein the second plenum is at least partially within the first plenum; and a mixing conduit extending through the second plenum and fluidly connecting the first plenum and the first passage, the mixing conduit defining at least one injection hole in fluid communication with the second plenum.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
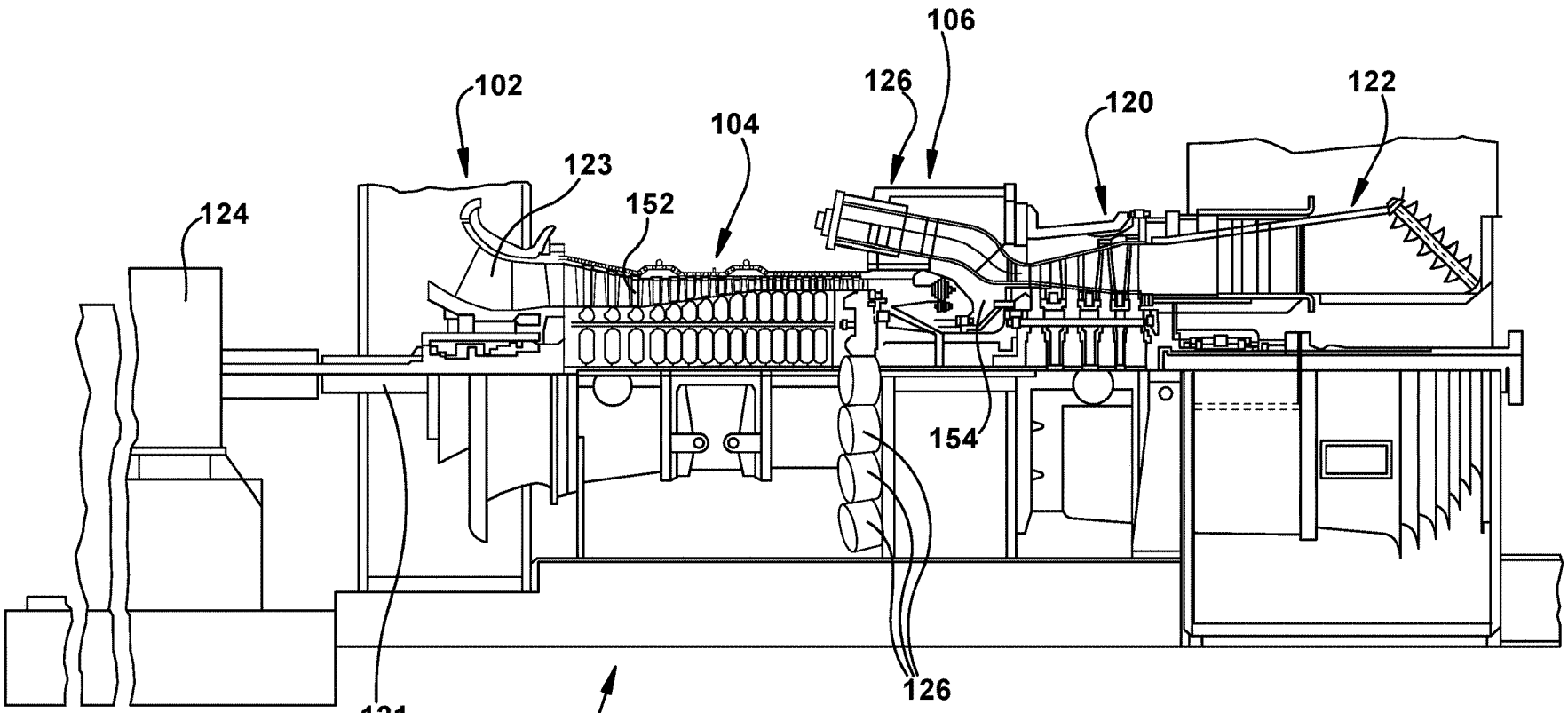
FIG. 1 shows a partial cross-sectional side view of a gas turbine (GT) system according to an embodiment of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

As an initial matter, in order to clearly describe the current disclosure, it is necessary to select certain terminology for reference to, and description, of relevant machine components within a gas turbine (GT) system. When possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include, and be referenced in another context as consisting of, multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or the present dual-pressure fuel nozzles. The term "downstream" corresponds to the direction of flow of the fluid, and the term "upstream" refers to the direction opposite to the flow (i.e., the direction from which the fluid flows). The terms "forward" and "aft," without any further specificity, refer to directions, with "forward" referring to the front or compressor end of the engine, and "aft" referring to the rearward or turbine end of the engine.

Additionally, it is often required to describe parts that are at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

Where an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides embodiments of a combustor head end assembly and a combustor. The combustor may include a combustor liner defining a combustion region including a primary, head end combustion zone and a secondary, axial fuel staging (AFS) combustion zone downstream from the primary combustion zone. A flow sleeve surrounds at least part of the combustor liner. The flow sleeve includes a plurality of cooling openings therein to direct a first air flow at a high pressure (e.g., compressor discharge pressure) from a first air source to cool an outer surface of the combustor liner and to create a second air flow at a lower pressure than the high pressure in an annulus between the combustor liner and the flow sleeve.

First fuel nozzle(s) is/are positioned at the primary combustion zone, and second fuel nozzle(s) is/are positioned at the secondary combustion zone. A fuel source is configured to deliver a first fuel to each of the first and second fuel nozzles. The fuel source may, in various embodiments, deliver a gas and/or a liquid fuel to the respective nozzles. The first and second fuel nozzles are both configured to use air flows of two different pressures to produce a premixture of the high pressure air flow and the fuel and then to produce a mixture of the premixture and the low pressure air flow, prior to introducing the mixture to the combustion region. The dual-pressure premixing nozzles can be used as part of a combustor head end assembly at a primary (head end) combustion zone alone, or as part of a combustor head end assembly at the primary combustion zone and as fuel nozzles at a secondary (AFS) combustion zone.

Use of the present dual-pressure premixing nozzles at both combustion zones improves fuel premixing at both zones. A short premixing residence time is created with the present combustor head end assembly, which is advantageous when the fuel contains high concentrations of highly reactive fuels, such as hydrogen. In addition, the fuel nozzles are fuel flexible (e.g., gas and/or liquid). The high velocity fuel nozzles reduce the inlet pressure and increase the overall turbulence inside the fuel nozzles, thereby enhancing the pre-mixed fuel nozzle performance by reducing emissions and reducing pressure drop requirements. The fuel nozzle outlets can be angled to direct fuel, where desired, to further improve fuel/air (F/A) mixing. The combustor head end assembly is usable in a can-annular combustor, a conventional annular combustor, or a segmented annular combustor. In the latter case, the combustion annulus may be separated into discrete combustion zones by a circumferential array of integrated combustor nozzles (ICNs), as described, for example, in U.S. patent application Ser. No. 15/464,394, published as US Patent Application Publication No. 2017-0276369A1.

FIG. 1 shows a partial cross-sectional view of an illustrative GT system 100 in which teachings of the disclosure may be employed. In FIG. 1, GT system 100 includes an intake section 102 and a compressor 104 downstream from intake section 102. Compressor 104 feeds air to a combustion section 106 that is coupled to a turbine section 120. Compressor 104 may include one or more stages of inlet guide vanes (IGVs) 123. As understood in the art, the angle of stages of IGVs 123 can be controlled to control an air flow volume to combustion section 106, and thus, among other things, the combustion temperature of section 106. Combustion section 106, as illustrated, includes a plurality of combustors 126, i.e., can-annular combustors, that combusts fuel and air to form a combustion product stream to drive turbine section 120. Exhaust from turbine section 120 exits via an exhaust section 122.

Turbine section 120 through a common shaft or rotor 121 drives compressor 104 and a load 124. Load 124 may be any one of an electrical generator and a mechanical drive application and may be located forward of intake section 102 (as shown) or aft of exhaust section 122. Examples of such mechanical drive applications include a compressor for use in oil fields and/or a compressor for use in refrigeration. When used in oil fields, the application may be a gas reinjection service. When used in refrigeration, the application may be in liquid natural gas (LNG) plants. Yet another load 124 may be a propeller as may be found in turbojet engines, turbofan engines, and turboprop engines.

Figure 2:
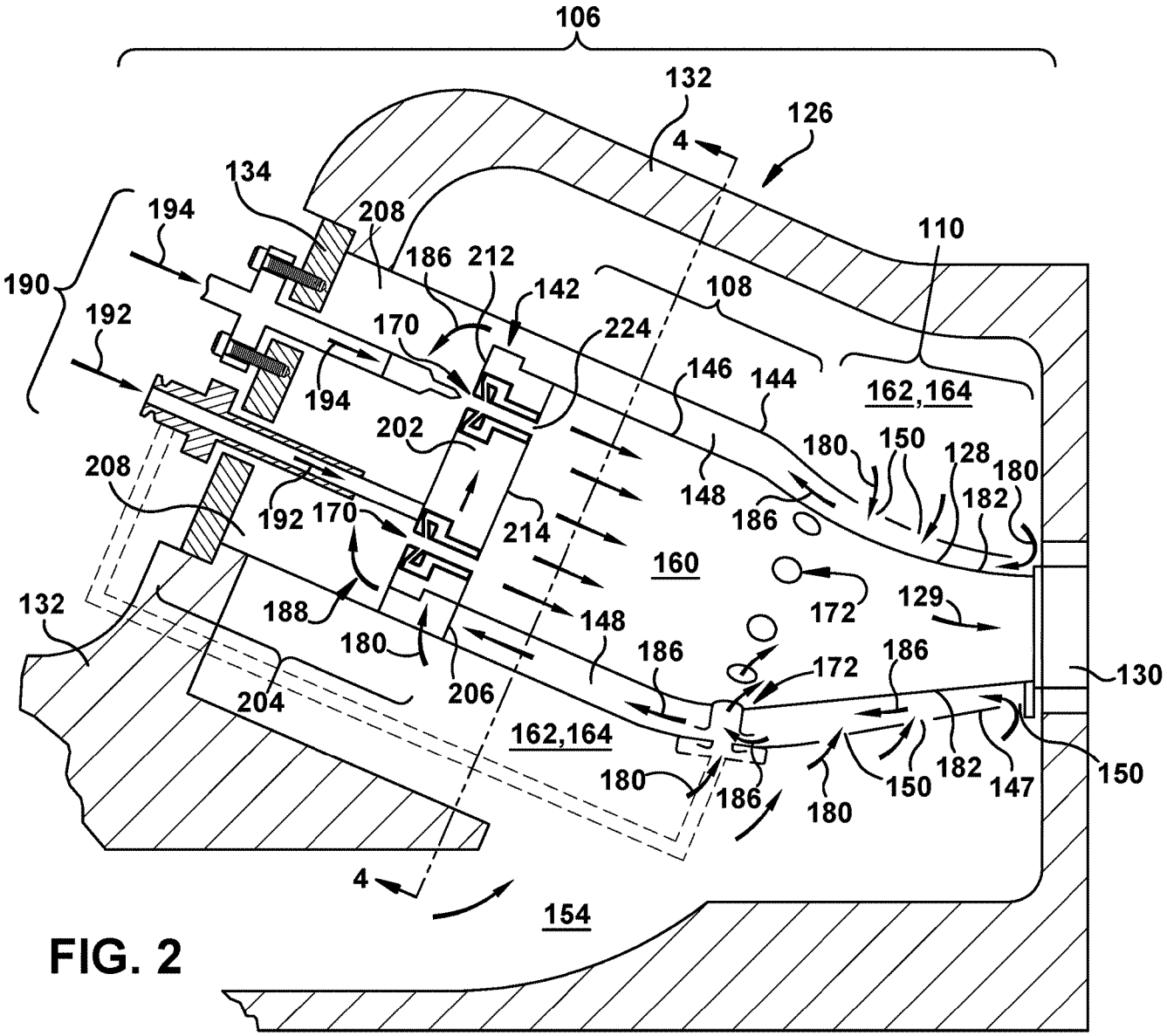
FIG. 2 shows a cross-sectional side view of a can-annular combustor for a combustion section useable in the GT system of FIG. 1.

Referring to the illustrative embodiment in FIG. 1, combustion section 106 may include a circular array of a plurality of circumferentially spaced can-annular combustors 126. FIG. 2 shows a cross-sectional view of an illustrative can-annular combustor 126. For purposes of the present description, only one combustor 126 is illustrated, it being appreciated that all of the other combustors 126 arranged about combustion section 106 are substantially identical to the illustrated combustor 126. Each combustor 126 includes a primary combustion zone 108 and a secondary combustion zone 110 downstream from primary combustion zone 108. Although FIG. 1 shows a plurality of circumferentially spaced combustors 126 and FIG. 2 shows a cross sectional side view of a can-annular combustor 126, it is contemplated that the present disclosure may be used in conjunction with other combustor systems including, and not limited to, annular combustors and segmented annular combustors with ICNs. Where applicable, application of the teachings of the disclosure to these other types of combustors will be provided herein.

Regardless of combustor system type, primary and secondary combustion zones 108, 110, each include one or more fuel nozzles 170, 172, respectively, in the form of dual-pressure fuel mixing apparatuses. Additional details of fuel nozzles 170, 172 may be as described in co-pending U.S. patent application Ser. Nos. 16/731,283 and 16/731,306, respectively entitled "Fluid Mixing Apparatus Using High- and Low-Pressure Fluid Streams," and "Fluid Mixing Apparatus Using Liquid Fuel and High- and Low-Pressure Fluid Streams,", filed concurrently herewith, and incorporated by reference herein. A fuel/air mixture is burned in each combustor 126 to produce a hot energetic combustion gas stream 129, which flows through a liner 146 and a transition piece 128 (FIG. 2) thereof to turbine nozzles 130 (FIG. 2) of turbine section 120 (FIG. 1).

Referring now to FIG. 2, there is shown generally a combustor 126 for GT system 100 (FIG. 1). Combustor 126 may include, or be positioned in a casing 132, typically referred to as a combustor discharge casing (CDC) or a combustor casing. Combustor 126 may include an end cover 134, a combustor head end assembly 142, a flow sleeve 144, and a combustor liner 146 within flow sleeve 144. Combustor liner 146 defines a combustion region 160 including a primary combustion zone 108 and a secondary combustion zone 110 downstream from primary combustion zone 108. Alternately, transition piece 128 may define secondary combustion zone 110. In other embodiments, liner 146 and transition piece 128 thereof may be formed as a single component instead of two separate components. Flow sleeve 144 surrounds at least part of combustor liner 146 and creates an annulus (annular plenum) 148 therebetween. Flow sleeve 144 includes a plurality of cooling openings 150 that allow for impingement cooling of an outer surface 182 of combustor liner 146, i.e., via impingement cooling. (A downstream portion of flow sleeve 147 may be referred to as a transition piece impingement sleeve.)

Compressor 104 (FIG. 1), which is represented by a series of vanes and blades at 152 and a diffuser 154 in FIG. 1, provides high pressure air 180 to a high-pressure air plenum 162 defined between casing 132 and flow sleeve 144, thus creating a high-pressure (HP) air source 164. That is, high-pressure air source 164 includes air plenum 162 defined between casing 132, i.e., a compressor discharge housing, and at least a portion of flow sleeve 144. The pressure P1 of high-pressure air 180 may depend on a number of factors such as but not limited to: size or operational status of compressor 104, position of IGVs 123 (FIG. 1), environmental conditions, and/or operational requirements of GT system 100 (FIG. 1).

Cooling openings 150 in flow sleeve 144 direct a flow of high-pressure air 180 at a first, high pressure P1 from high-pressure air source 164 to cool outer surface 182 of combustor liner 146 or transition piece 128 thereof, i.e., via impingement cooling. Any number of cooling openings 150 may be provided. As a consequence of the flow of high-pressure air 180 entering cooling openings 150, a flow of a low-pressure air 186 is created at a second, lower pressure P2 than first pressure P1, i.e., P2<P1. Second air flow 186 flows upstream in annulus 148 between combustor liner 146 and flow sleeve 144, resulting in annulus 148 providing a low-pressure (LP) air source 188. The pressure P2 of low-pressure air 186 may depend on a number of factors such as but not limited to: size or operational status of compressor 104, position of IGVs 123 (FIG. 1), environmental conditions, operational requirements of GT system 100 (FIG. 1), number and size of cooling openings 150, back pressure along annulus 148, temperature of the air, and/or temperature of combustion liner 146 and/or transition piece 128 thereof.

In one embodiment, shown in FIG. 2, combustor 126 includes first fuel nozzle(s) 170 positioned in combustor head end assembly 142 at (just upstream of) primary combustion zone 108, and second fuel nozzle(s) 172 positioned through combustion liner 146 or transition piece 128 thereof at secondary combustion zone 110 to define an axially staged fuel delivery system. Each of fuel nozzles 170, 172 may include a two-pressure pre-mixing apparatus, as will be described herein. Any number of fuel nozzles 170 may be employed at primary combustion zone 108 in combustor head end assembly 142 (hereinafter just "head end assembly 142"), and any number of circumferentially arranged fuel nozzles 172 may be employed at secondary combustion zone 110. In another embodiment, shown in FIG. 3, combustor 126 may include only first fuel nozzle(s) 170 positioned at primary combustion zone 108 in head end assembly 142, i.e., no AFS fuel nozzles are provided.

Combustor 126 may also include one or more fuel sources 190 configured to deliver a fuel 192, e.g., a gas fuel (like natural gas, hydrogen, etc.) and/or a fuel 194, e.g., a liquid fuel (like distillate oil or other petroleum product), to each of first and/or second fuel nozzles 170, 172. Fuel source 190 may include any now known or later developed fuel source including, e.g., fuel reservoirs, control systems, piping, valves, meters, sensors, fuel atomizers for liquids, etc.

As will be described in greater detail, first and second fuel nozzles 170, 172 produce a premixture of high-pressure air 180 and a fuel (gas fuel 192 and/or liquid fuel 194), and produce a mixture of the premixture (i.e., high-pressure air 180 and fuel) and low-pressure air 186, prior to introducing the mixture to a respective primary combustion zone 108 or secondary combustion zone 110.

With further regard to first fuel nozzle(s) 170 and head end assembly 142 for combustor 126 (FIGS. 2 and 3) of GT system 100 (FIG. 1), embodiments of the disclosure may provide a head end arrangement 204 including head end assembly 142 and a plurality of first fuel nozzles 170 installed through head end assembly 142. As shown best in FIGS. 2 and 3, head end assembly 142 may be mounted to combustor liner 146 in any now known or later developed fashion, e.g., fasteners, welding, integral formation, etc.

Figure 4:
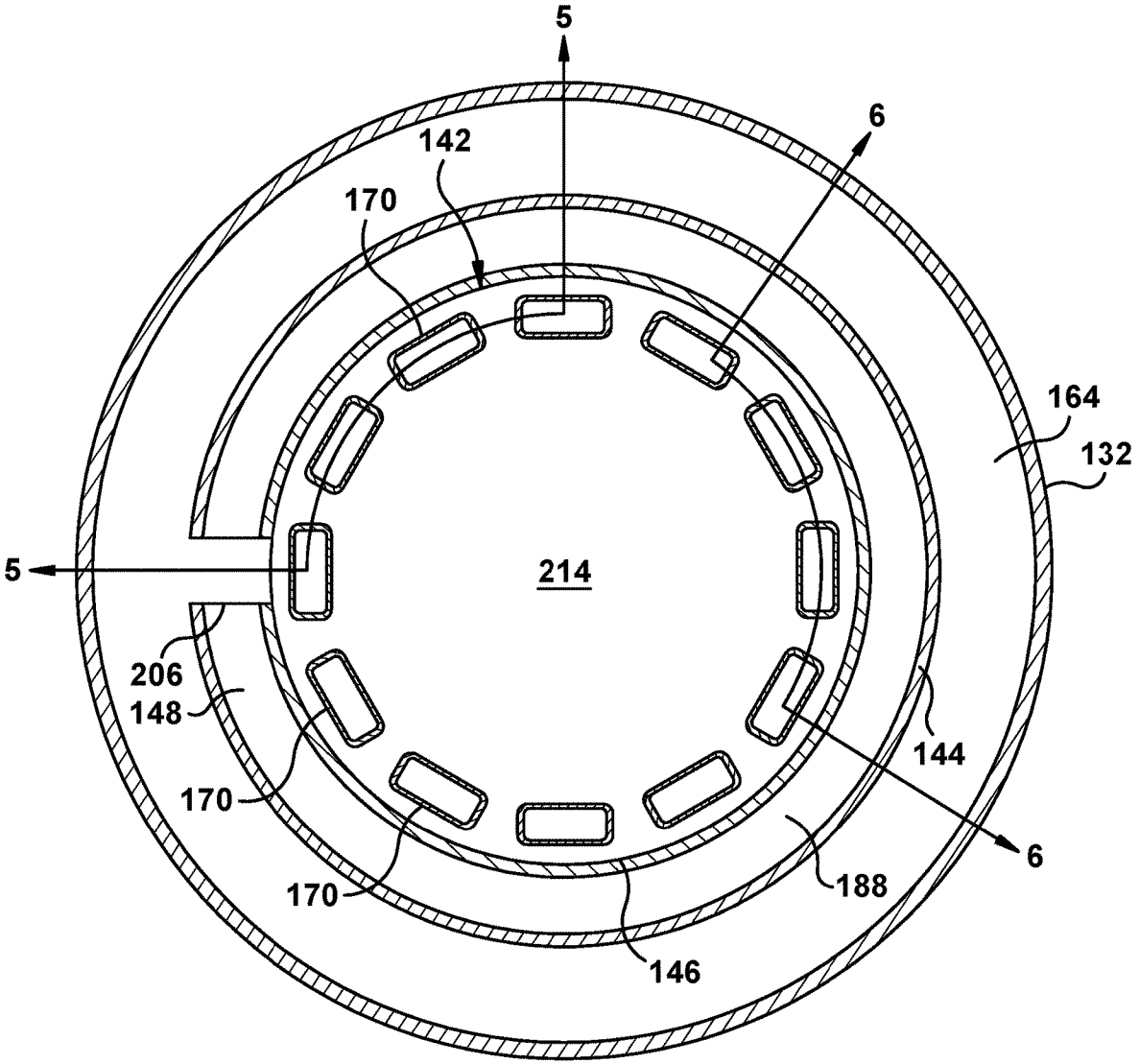
FIG. 4 shows a cross-sectional upstream view of a combustor head end assembly for mixing two pressure air flows and a fuel flow according to an embodiment of the disclosure.
Figure 5:
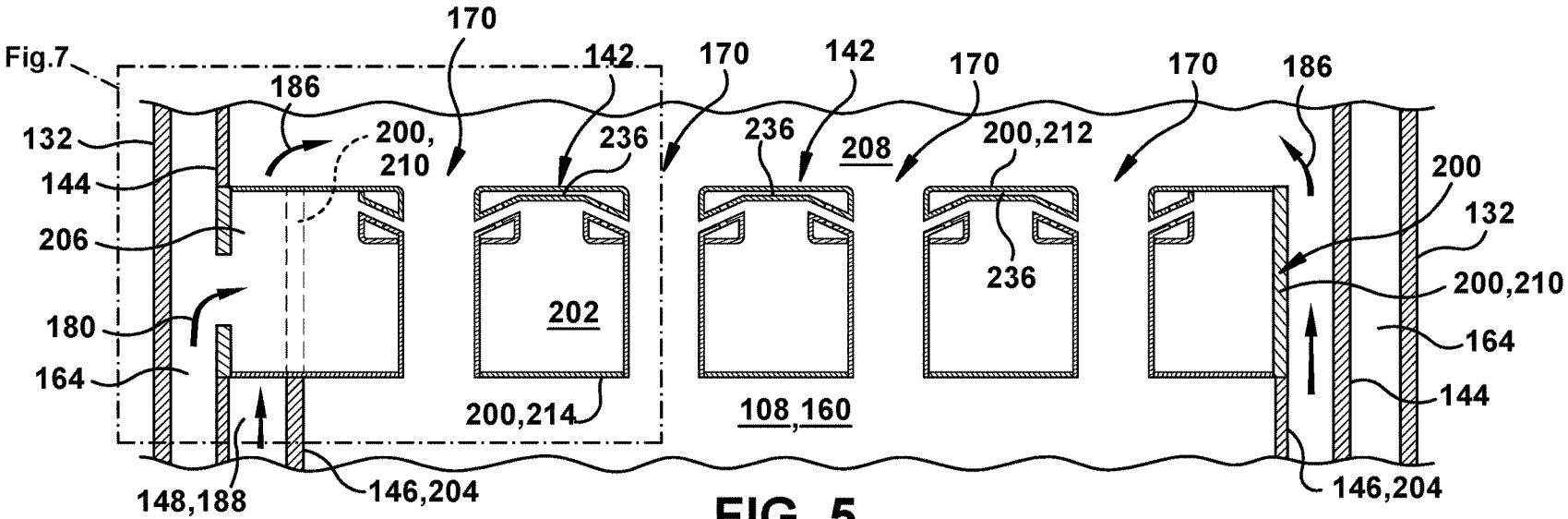
FIG. 5 shows a cross-sectional view of a combustor head end assembly along view line 5-5 in FIG. 4 according to an embodiment of the disclosure.
Figure 6:
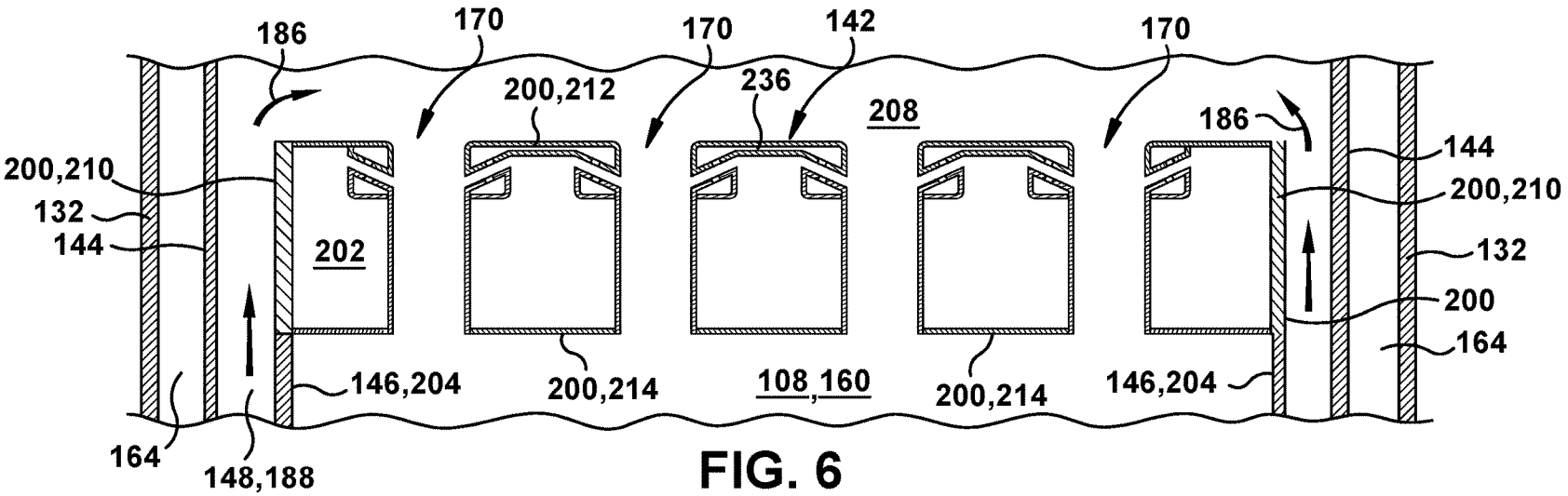
FIG. 6 shows a cross-sectional view of a combustor head end assembly along view line 6-6 in FIG. 4 according to an embodiment of the disclosure.
Figure 7:
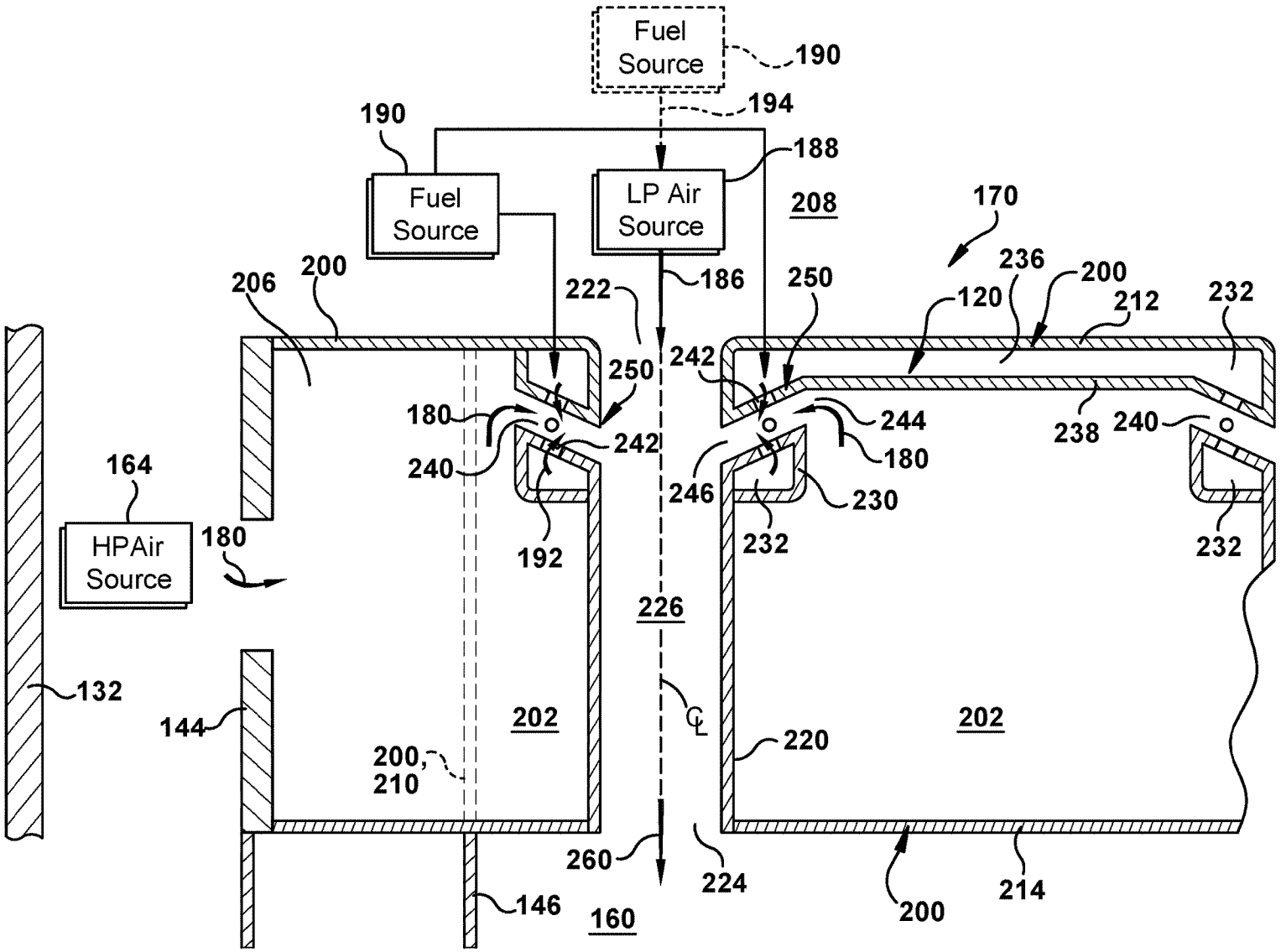
FIG. 7 shows an enlarged schematic cross-sectional view of a first fuel nozzle that mixes two pressure air flows and a fuel flow and may be used in the combustor head end assembly as shown in FIG. 5 according to an embodiment of the disclosure.

FIG. 4 shows a cross-sectional upstream view of head end assembly 142 for mixing two air flows of different pressures and a fuel flow for combustion within combustion region 160 (FIG. 2) (see view line 4-4 in FIG. 2), according to an embodiment of the disclosure. FIG. 5 shows a cross-sectional view of head end assembly 142 along view line 5-5 in FIG. 4, FIG. 6 shows a cross-sectional view of head end assembly 142 along view line 6-6 in FIG. 4, and FIG. 7 shows an enlarged schematic cross-sectional view of a first fuel nozzle 170 for head end assembly 142, as denoted in FIG. 5.

Head end assembly 142 may include a first wall 200 defining a first plenum 202 in fluid communication with high-pressure air source 164. In one embodiment, first wall 200 may form a generally boxed structure (FIGS. 5-6) configured to mount to an upstream end of combustor liner 146. First wall 200 may have a first side 212 that defines an upstream surface; a spaced, opposing second side 214 that defines a downstream surface; and an outer annular wall 210 extending between and coupled to first side 212 and second side 214, forming first plenum 202 therein. Head end assembly 142 and, in particular, second side 214 of first wall 200 forms an upper boundary of combustion region 160 with combustor liner 146.

Figure 3:
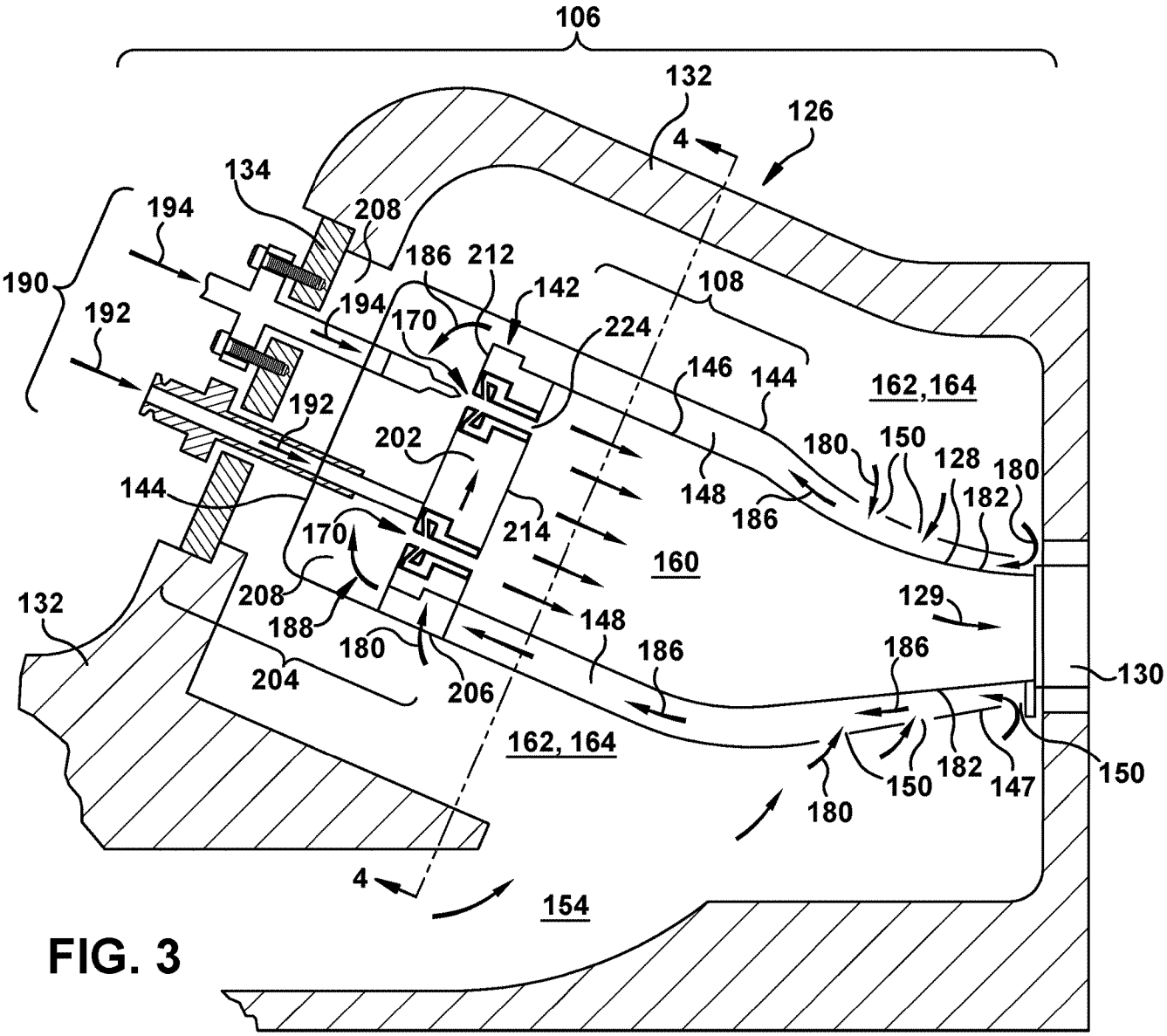
FIG. 3 shows a cross-sectional side view of another can-annular combustor for a combustion section useable in the GT system of FIG. 1.

In FIGS. 2 and 3, head end assembly 142 is circular because the example is for a can-annular combustor 126 (FIG. 2), which typically has a circular shape (see, e.g., circumferentially spaced can-annular combustors in FIG. 1). That is, first side 212 and second side 214 are circular. As will be described in greater detail, head end assembly 142 may have a variety of different shapes depending on the type of combustor in which employed.

Head end assembly 142 also includes, as will be described in greater detail herein, a plurality of fuel nozzles 170 extending through first plenum 202. Any number of fuel nozzles 170 (e.g., twelve) may be employed in a circular assembly, as shown in the illustrative assembly of FIG. 4.

As shown in FIGS. 4 and 5, a connector passage 206 may traverse annulus 148 to fluidly couple first plenum 202 and high-pressure air source 164, to deliver high-pressure air 180 to first plenum 202. Connector passage 206 may be at any circumferential position on head end assembly 142, and more than one connector passage 206 may be used. Connector passage 206 can have any size and shape and position to allow a sufficient volume of high-pressure air 180 to supply first nozzles 170 in head end assembly 142. In FIG. 5, low-pressure air 186 passes about connector passage 206 (behind as shown); however, FIG. 6 shows that annulus 148 continues uninterrupted where connector passage 206 is not provided.

As shown best in FIGS. 2 and 3, low-pressure air source 188 may also include a head end plenum 208. Head end plenum 208 may be defined in a number of variations. In FIG. 2, head end plenum 208 is defined, on opposite sides, by first (upstream) side 212 of first wall 200 (that defines first plenum 202) and end cover 134. In addition, in FIG. 2, head end plenum 208 is bounded circumferentially by flow sleeve 144 (extends into compressor discharge casing 132).

An optional inlet flow conditioner (not shown), which extends upstream of head end assembly 142 at a position aligned with combustor liner 146, may be provided. In an alternative embodiment, shown in FIG. 3, a head end plenum 208 may be defined by first side 212 of first wall 200 (first plenum 202) of head end assembly 142 with only flow sleeve 144. Here, flow sleeve 144 closes around head end assembly 142. In any event, head end plenum 208 receives low-pressure air 186 from annulus 148. Each first nozzle 170 includes an inlet 222 in fluid communication with head end plenum 208 such that each first nozzle 170 receives a flow of low-pressure air 186 from the shared head end plenum 208.

Referring to FIGS. 5-7 collectively, fuel nozzle(s) 170 in head end assembly 142 may include substantially identical structure. Fuel nozzle(s) 170 may include a first annular wall 220 defining: an inlet 222 at first (upstream) side 212 of first plenum 202, an outlet 224 at second (downstream) side 214 of first plenum 202 and open to combustion region 160 of the combustor, and a first main passage 226 extending between inlet 222 and outlet 224. First annular wall 220 may be a cylinder or may have a radial cross-section defining a non-circular shape, such as an elliptical shape, a racetrack shape, or a polygonal shape (e.g., a rectangular shape). Inlet 222 is open to low-pressure air source 188, allowing low-pressure air 186 to enter inlet 222.

Fuel nozzle(s) 170 may also include a second annular wall 230 circumscribing first annular wall 220 to define a second plenum 232 in fluid communication with a fuel source 190. As shown best in FIG. 7, second plenum 232 is at least partially within first plenum 202. Head end assembly 142 may include a fuel manifold 236 fluidly coupling each second plenum 232 within first plenum 202 to fuel source 190, fuel source 190 being fluidly coupled to fuel manifold 236. Fuel manifold 236 may be formed by any form of conduit 238 fluidly coupling second plenums 232. Conduit 238 can be formed in any fashion, e.g., by a pipe running between plenums 232 within first plenum 202. Where second plenum 232 is used to deliver fuel, the fuel 192 may include a gas fuel such as natural gas, propane, etc.

Fuel nozzle(s) 170 also include a mixing conduit 240 extending through second plenum 232 and fluidly connecting first plenum 202 and main passage 226. Mixing conduit 240 defines at least one injection hole 242 in fluid communication with second plenum 232. Each of one or more mixing conduits 240, which extend through second plenum 232, has an inlet 244 that is fluidly connected to first plenum 202 and an outlet 246 that is fluidly connected with main passage 226. That is, each first nozzle 170 shares common first plenum 202 in head end assembly 142. One or more injection holes 242 are defined through each mixing conduit 240 and are in fluid communication with plenum 232. Fuel 192 flows through one or more injection holes 242 into a passage 250 defined by each mixing conduit 240. In one embodiment, mixing conduits 240 are oriented at an angle relative to an axial centerline $C_L$ of fuel nozzle 170. Preferably, mixing conduits 240 are oriented at an angle to direct the flow therethrough in a downstream direction (i.e., toward outlet 224). Mixing conduits 240 (individually) are shorter and of smaller diameter than first annular wall 220.

In operation, for each first nozzle 170, high-pressure air 180 from high-pressure air source 164 flows through first plenum 202 and into main passage 226 (via mixing conduit 240), while fuel 192 flows through one or more injection holes 242 into main passage 226. The pressure of first high-pressure air 180 rapidly carries fuel 192 into main passage 226 defined by first annular wall 220 creating a pre-mixture. High-pressure air 180 also draws low-pressure air 186 into inlet 222 of main passage 226. Within main passage 226, the pre-mixture of high-pressure air 180 and fuel 192 are mixed with low-pressure air 186 to produce a mixed fuel/air mixture 260 that exits from outlet 224 of main passage 226 to combustion region 160 of combustor 126 (FIG. 2). Consequently, a combustion reaction occurs within primary combustion zone 108 of combustor liner 146 creating a combustion gas stream 129 (FIG. 2) releasing heat for the purpose of driving turbine section 120 (FIG. 1).

Figure 8:
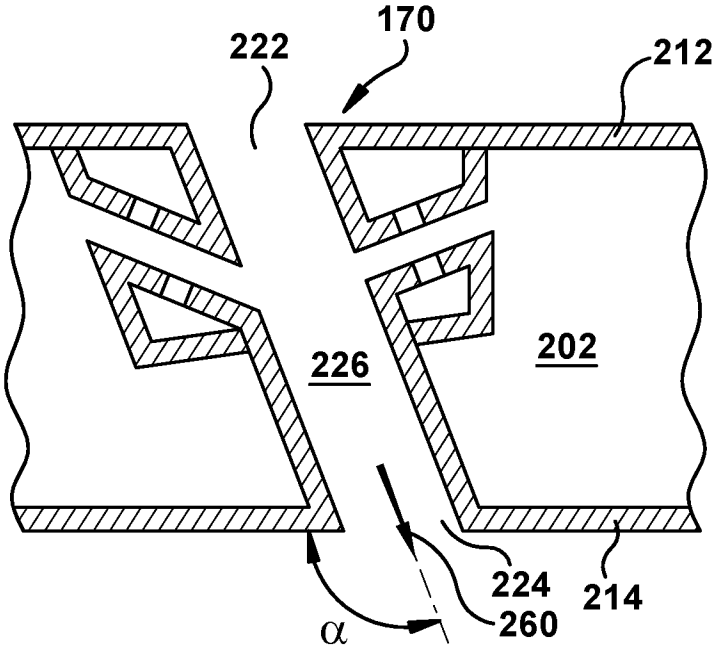
FIG. 8 shows an enlarged schematic cross-sectional view of the first fuel nozzle for use in a combustor head end assembly according to an alternative embodiment of the disclosure.

Head end assembly 142 may be arranged in a number of different ways to customize it for a particular combustor, and/or make it applicable to a wide variety of combustor types. In one embodiment, shown in FIG. 8, at least one of the plurality of fuel nozzles 170 may have outlet 224 arranged at a non-perpendicular angle $\alpha$ relative to head end assembly 142, i.e., second side 214 of first plenum 202 at combustion region 160. In this manner, fuel/air mixture 260 may be directed at angle $\alpha$ into combustion region 160 to generate a swirling flow. Where a number of nozzles 170 are so arranged, mixing of fuel and air can be further enhanced by aiming nozzles 170, e.g., toward each other. While main passage 226 is shown angled along an entire length thereof relative to second side 214, it may only be angled at or near outlet 224. Any number of nozzles 170 may be angled in this fashion to direct fuel/air mixture 260 where desired. The angle $\alpha$ need not be identical amongst all of first nozzles 170 provided.

Figure 10:
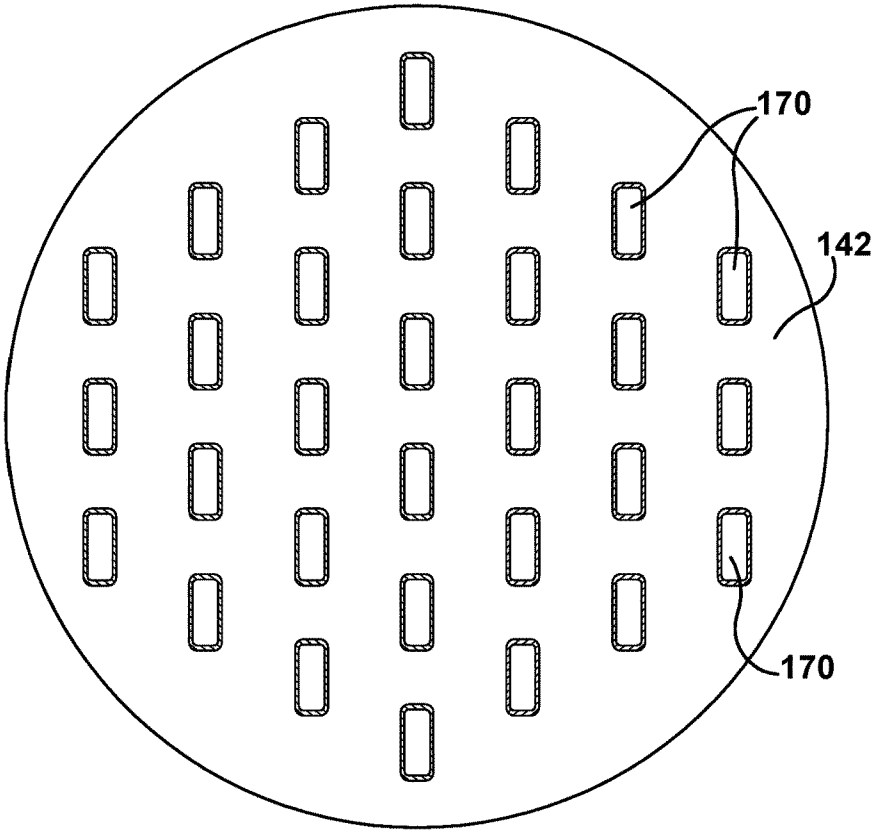
FIG. 10 shows an end view of a combustor head end assembly according to yet another embodiment of the disclosure.
Figure 9:
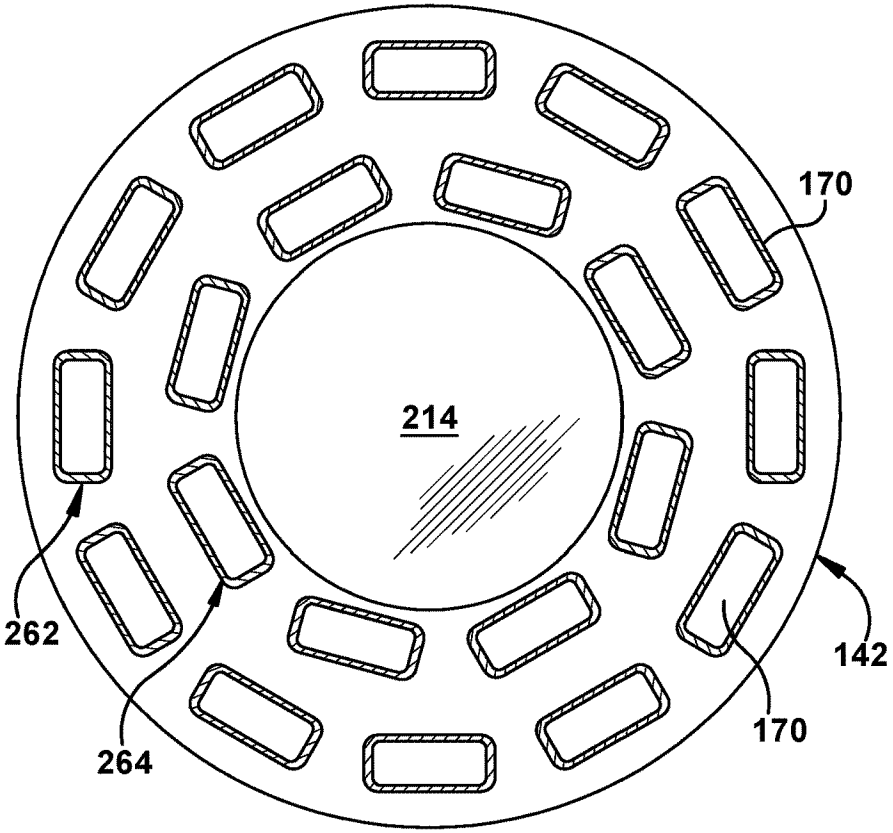
FIG. 9 shows an end view of a combustor head end assembly according to another embodiment of the disclosure.

In another embodiment, plurality of fuel nozzles 170 may be arranged in a number of different patterns within head end assembly 142. In one embodiment, shown in FIG. 4, fuel nozzles 170 are arranged in head end assembly 142 in an annular fashion, i.e., a ring, facing into combustion region 160 (FIG. 2). In another example, shown in FIG. 9, fuel nozzles 170 may be arranged in a pair of concentric rings 262, 264 in head end assembly 142 as they face into combustion region 160 (FIG. 2). In FIG. 10, fuel nozzles 170 are arranged in a more linear fashion in head end assembly 142. Practically any arrangement is possible, allowing for a high level of customization of fuel/air mixture introduction into combustion region 160.

Figure 11:
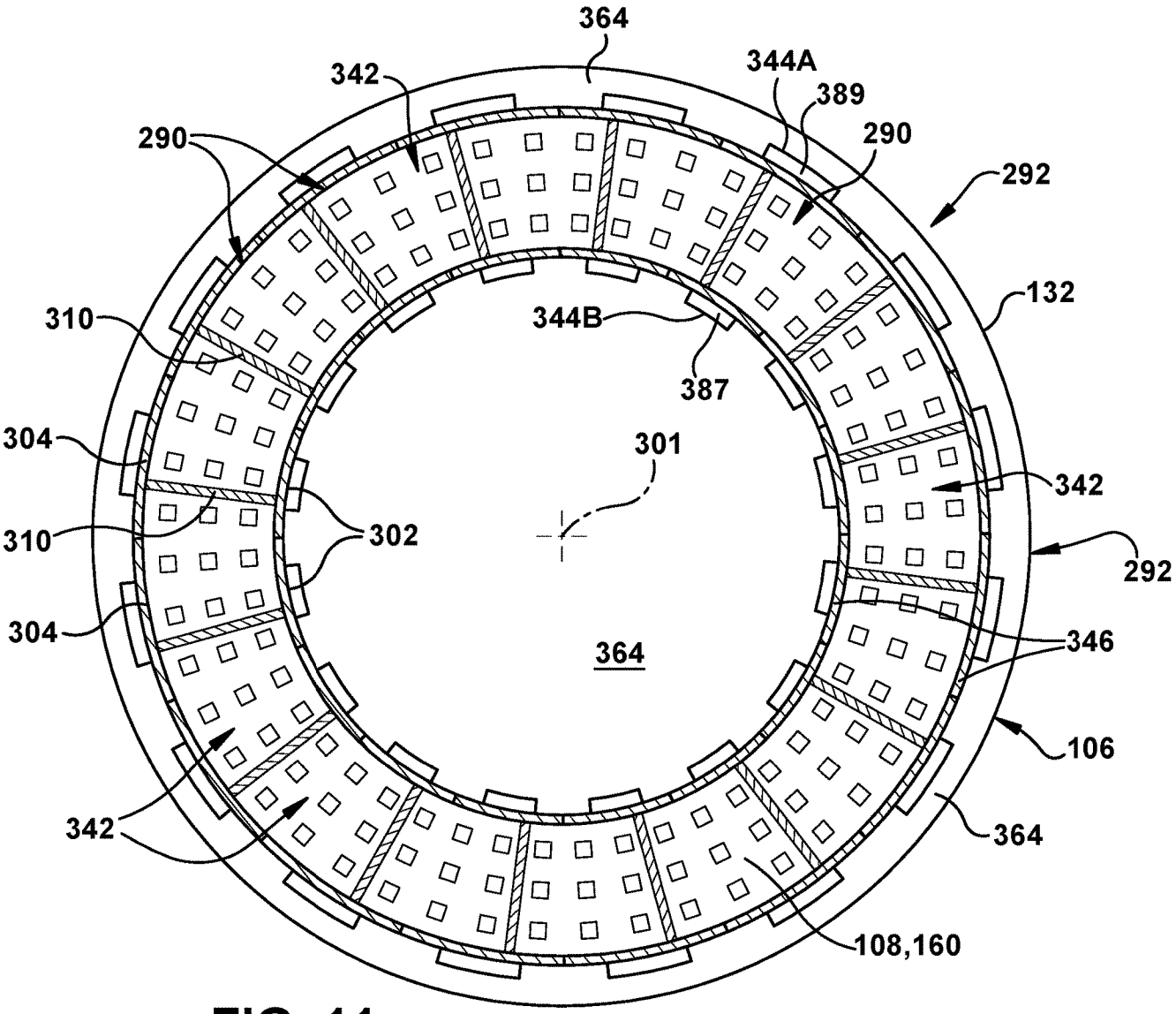
FIG. 11 shows an upstream view of an illustrative segmented annular combustor, which may employ a combustor head end assembly as described herein.

FIG. 11 shows an upstream (i.e., an aft-looking-forward) view of the combustion section 106 (FIG. 1), according to an alternate embodiment of the present disclosure. As shown in FIG. 11, combustion section 106 may be an annular combustion system and, more specifically, a segmented annular combustor 292 in which an array of integrated combustor nozzles 290 are arranged circumferentially about an axial centerline 301 of GT system 100 (FIG. 1). Axial centerline 301 may be coincident with shaft 121 (FIG. 1). Segmented annular combustor 292 may be at least partially surrounded by an outer casing 132, sometimes referred to as a compressor discharge casing. Casing 132, which receives high-pressure air 180 from compressor 104 (FIG. 1), may at least partially define a high-pressure air source 364 that at least partially surrounds various components of segment annular combustor 292 and is also within a center of the combustor. High-pressure air 180 is used for combustion, as described above, and for cooling combustor hardware.

Figure 12:
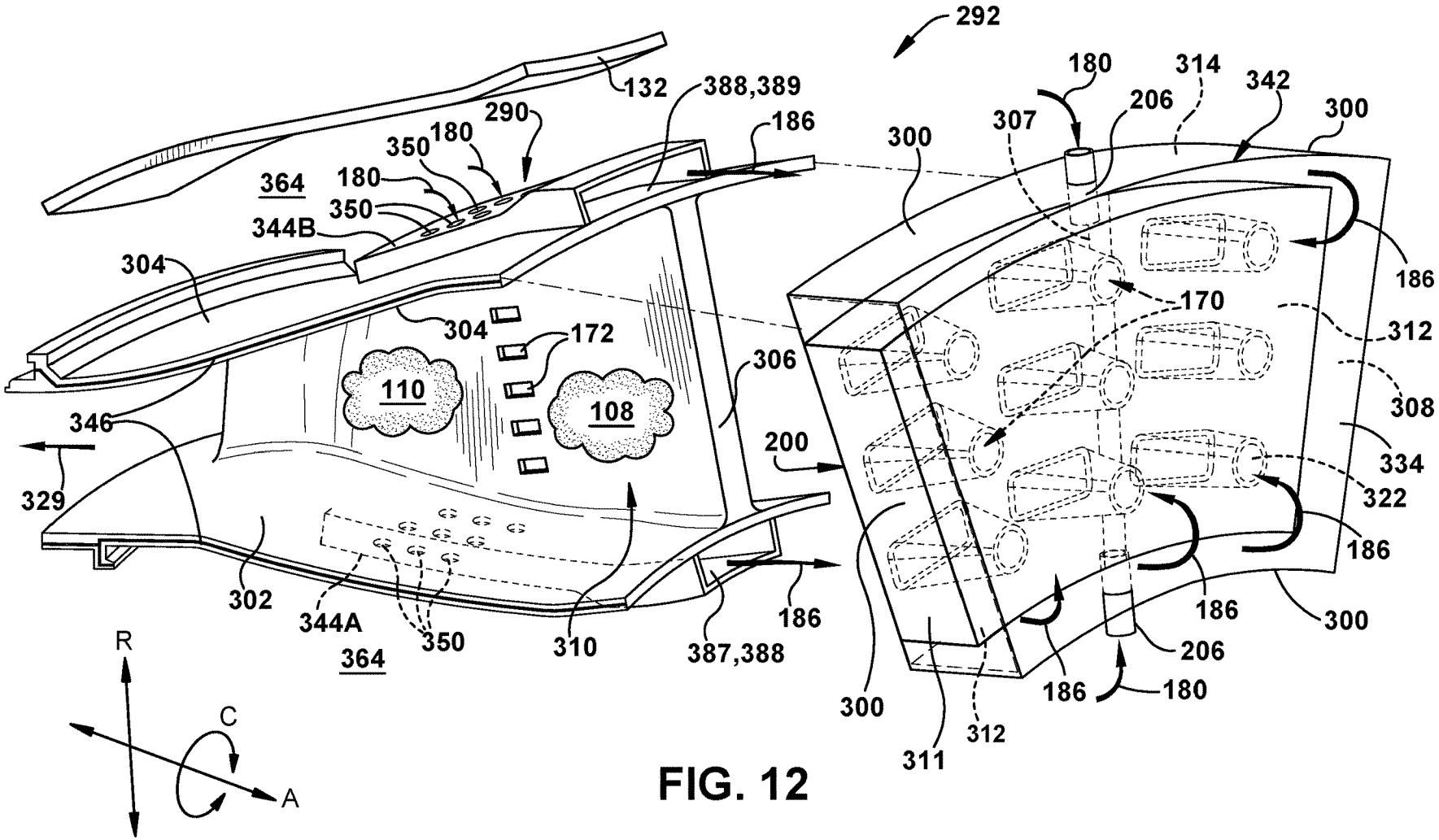
FIG. 12 shows a side, exploded perspective view of an integrated combustor nozzle (ICN) used in the segmented annular combustor of FIG. 11.

Segmented annular combustor 292 includes a circumferential array of integrated combustor nozzles 290, one of which is shown in a side, exploded perspective view in FIG. 12. As shown in FIG. 12, each integrated combustor nozzle (ICN) 290 includes an inner liner segment 302, an outer liner segment 304 radially separated from inner liner segment 302, and a hollow or semi-hollow fuel injection panel 310 extending radially between inner liner segment 302 and outer liner segment 304, thus generally defining an "I"-shaped assembly. Collectively, inner liner segments 302 and outer liner segments 304 create a combustion liner 346 (FIG. 11). Combustion liner 346 defines combustion region 160 including primary combustion zone 108 and secondary combustion zone 110 downstream from primary combustion zone 108. Fuel injection panels 310 separate the combustion region 160 into an annular array of fluidly separated combustion areas (one area is identified in FIG. 12 by primary combustion zone 108 and secondary combustion zone 110). In this setting, high pressure air 180 passes through cooling openings 350, thereby losing pressure and becoming low-pressure air 186.

Figure 13:
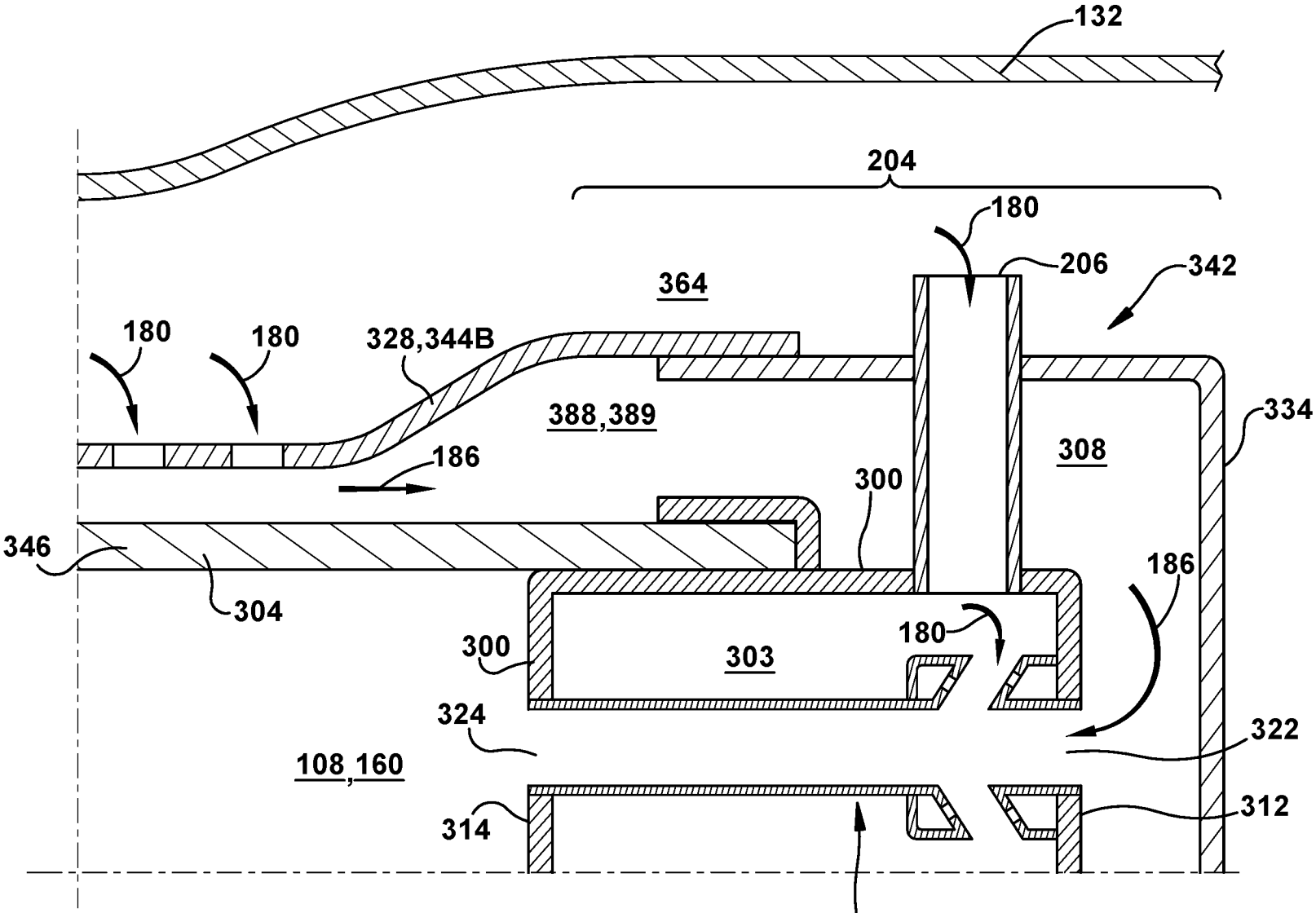
FIG. 13 shows a partial cross-sectional view of a portion of a head end assembly for use with an ICN used in the segmented annular combustor of FIG. 11.

At the upstream end of segmented annular combustor 292, a segmented combustor head end assembly 342 (hereinafter after "head end assembly 342") extends circumferentially adjacent ends 306 of fuel injection panels 310 and radially from inner liner segment 302 beyond outer liner segment 304. FIG. 13 shows a partial cross-sectional view of a head end assembly 342 for use with ICN 290. Circumferentially arranged, segmented head end assemblies 342 include one or more fuel nozzles 170 that introduce a fuel/air mixture into a circumferential array of upstream, primary combustion zones 108, as described herein relative to FIGS. 5 and 6. Each head end assembly 342 has a structure similar to that shown in FIGS. 5 and 6, except first wall 200 (e.g., first annular wall 210, and sides 212, 214 (FIGS. 5-6)) may have wall segments with an arcuate profile viewed from an aft position looking forward, as shown in FIG. 11. Consequently, head end assembly 342 is arcuate. With reference to FIG. 11 and FIG. 12, it is noted that each head end assembly 342 may overlap with an end 306 of a fuel injection panel 310. For example, end 306 of fuel injection panel 310 may mate with an area 307 in a side 314, i.e., boundary plate, of head end assembly 342 that is devoid of nozzles 170, and faces combustion region 160. In this manner, ends 306 of fuel injection panel 310 do not mate with seams between adjacent head end assemblies 342.

An inner flow sleeve 344A is positioned radially inward of inner liner segment 302, creating an inner plenum 387, and an outer flow sleeve 344B is positioned radially outward of outer liner segment 304, creating an outer plenum 389. Flow sleeves 344A, 344B thus surround at least part of combustor liner 346. Cooling openings 350 are positioned in each flow sleeve 344A, 344B, making them cooling impingement sleeves. Cooling openings 350 are positioned radially inward from inner liner segment 302 and radially outward from outer liner segment 304. A first portion of high pressure air 180 from high-pressure air source 364, defined between casing 132 and flow sleeves 344B and inside of flow sleeve 344A, flows through cooling openings 350 in flow sleeves 344A, B. Thus, flow sleeves 344A, 344B and cooling openings 350 direct the portion of high pressure air 180 from high-pressure air source 364 to cool an outer surface of combustor liner 346, i.e., radially inner surface of inner liner segment 302 and radially outer surface of outer liner segment 304. In addition, flow sleeves 344A, 344B and cooling openings 350 create a flow of low-pressure air 186 upstream in inner and outer plenums 387, 389, creating a low-pressure air source 388 for head end assembly 342. (Plenums 387, 389 create a circumferentially segmented annulus, comparable to annulus 148 in FIGS. 2 and 3.) As will be described, a second portion of high-pressure air 180 is directed into fuel nozzles 170 in head end assembly 342.

Head end assembly 342 may include a first wall 300 defining a high-pressure plenum 303 (similar to first plenum 202 in FIGS. 7 and 8) in fluid communication with high-pressure air source 364. In one embodiment, first wall 200 may form a generally boxed structure (similar to FIGS. 5-6) configured to mount to an upstream end of combustor liner 346. First wall 200 may have a first side 312 that defines an upstream surface; a spaced, opposing second side 314 that defines a downstream surface; and an outer side 311 extending between and coupled to first side 312 and second side 314, forming high-pressure plenum 303 therein. Head end assembly 142 and, in particular, second side 314 of first wall 200 forms an upper boundary of combustion region 160 with combustor liner 346. High-pressure air 180 from high-pressure air source 364 defined by casing 132 flows into high-pressure air plenum 303 defined within head end assembly 342, via one or more connectors 206. Sides 312, 314 are arcuate, creating an arcuate high-pressure air plenum 303 for use in segmented annular combustor 292.

As shown in FIGS. 12 and 13, a connector passage 206 may traverse plenums 387, 389 to fluidly couple high-pressure plenum 303 and high-pressure air source 364, to deliver high-pressure air 180 to high-pressure plenum 303. Connector passage 206 may be at any circumferential position on head end assembly 142, and more than one connector passage 206 may be used (two in FIG. 12). Connector passage 206 can have any size and shape and position to allow a sufficient volume of high-pressure air 180 to supply first nozzles 170 in head end assembly 342. In FIGS. 12 and 13, low-pressure air 186 passes about connector passage 206 (behind as shown in FIG. 13).

Inner and outer plenums 387, 389 direct low-pressure air 186 into a low-pressure head end plenum 308, where low-pressure air 186 enters fuel nozzles 170 in a generally axial direction. Low-pressure head-end plenum 308 includes an upstream plate 334 that cooperatively interacts with side 312 of wall 311 of head end assembly 342 (separates low-pressure head end plenum 308 from high-pressure head-end plenum 303), and wall 210 that extends axially between upstream plate 334 and side 314. In any event, head end plenum 308 receives low-pressure air 186 from plenums 387, 389. Each first nozzle 170 includes an inlet 322 in fluid communication with head end plenum 308 such that each first nozzle 170 receives a flow of low-pressure air 186 from the shared low-pressure head end plenum 308.

Fuel nozzle(s) 170 in head end assembly 342 may include substantially identical structure as that described relative to FIGS. 5-7.

With reference to FIGS. 7 and 13, in operation, for each first nozzle 170, high-pressure air 180 from high-pressure air source 364 flows through high-pressure plenum 303 and into main passage 226 (via mixing conduit 240), while fuel 192 flows through one or more injection holes 242 into main passage 226. The pressure of first high-pressure air 180 rapidly carries fuel 192 into main passage 226 defined by first annular wall 220 creating a pre-mixture. High-pressure air 180 also draws low-pressure air 186 into inlet 222 of main passage 226. Within main passage 226, the pre-mixture of high-pressure air 180 and fuel 192 are mixed with low-pressure air 186 to produce a mixed fuel/air mixture 260 that exits from outlet 224 of main passage 226 to combustion region 160 of segmented annular combustor 292 (FIG. 11). Consequently, a combustion reaction occurs within primary combustion zone 108 of combustor liner 346 creating a combustion gas stream 329 releasing heat for the purpose of driving turbine section 120 (FIG. 1).

As described in greater detail in related U.S. patent application Ser. Nos. 16/731,283 and 16/731,306, to achieve greater operational range (e.g., turn-down) and lower emissions, fuel injection panels 310 include plurality of second nozzles 172 therein, which introduce fuel into one or more secondary combustion zones 110. Combustion zones 110 are downstream of primary combustion zones 108 created by the injection of the fuel/air mixtures delivered by head end assemblies 342. That is, second nozzles 172 are part of one or more integrated combustor nozzles (ICN) 290. Collectively, segmented annular combustors 292 create a combustion gas stream for driving turbine section 120 (FIG. 1).

Figure 14:
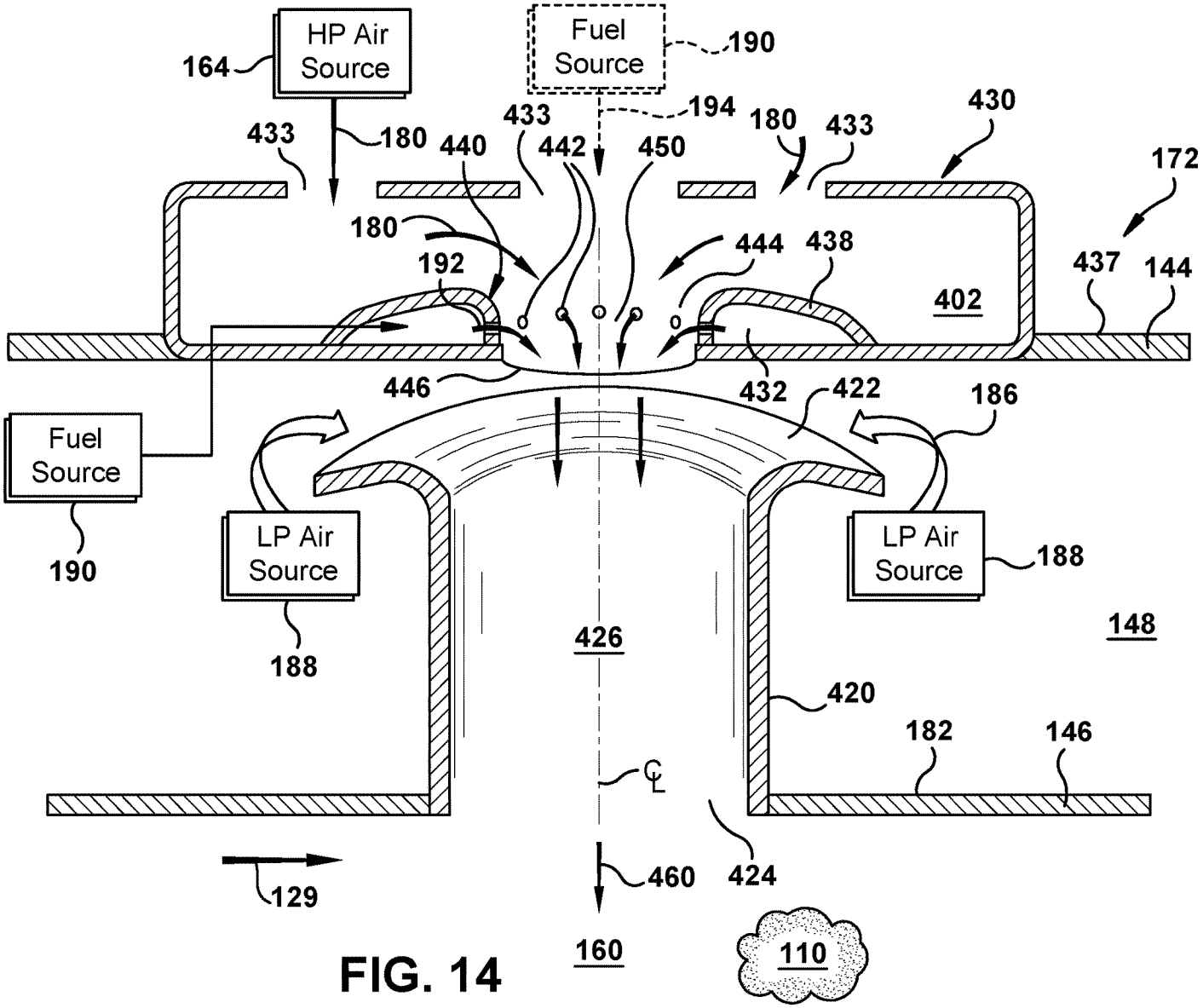
FIG. 14 shows a schematic cross-sectional view of a second fuel nozzle for mixing two pressure air flows and a fuel flow and which may be used in a secondary combustion zone according to an embodiment of the disclosure.
Figure 15:
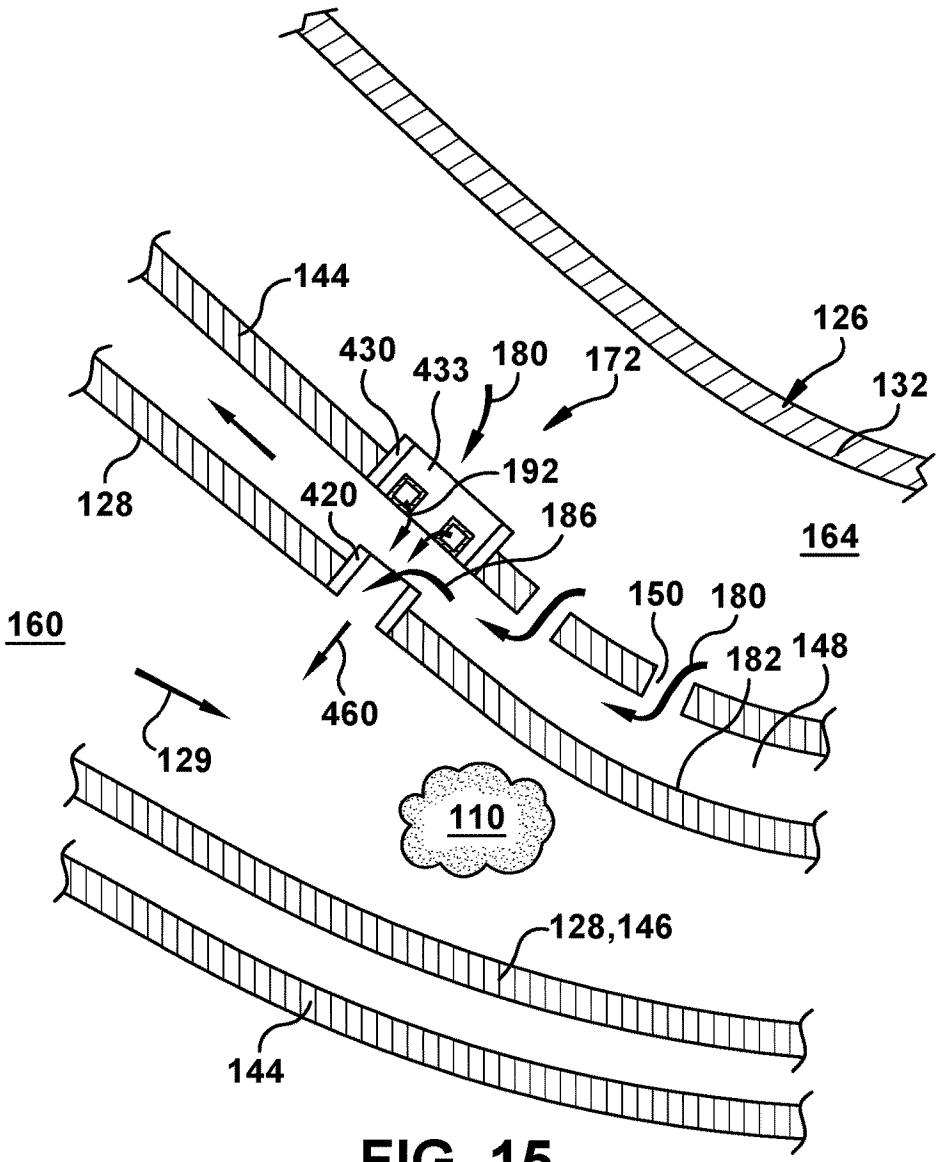
FIG. 15 shows an enlarged, schematic side cross-sectional view of a portion of a can-annular combustor, as in FIG. 2, that includes the second fuel nozzle of FIG. 14.

As shown in FIG. 2, can-annular combustor 126 may employ first and second nozzles 170, 172 at primary and secondary combustion zones 108, 110, respectively. FIGS. 14 and 15 show schematic cross-sectional views of second nozzle 172 that may be employed in can-annular combustor 126 at secondary combustion zones 110, according to embodiments of the disclosure. FIG. 14 shows a schematic cross-sectional view of second fuel nozzle 172; and FIG. 15 shows an enlarged, schematic side cross-sectional view of a portion of can-annular combustor 126, as in FIG. 2, that includes second fuel nozzle 172 of FIG. 14.

In one embodiment, second fuel nozzle 172 includes a first annular wall 420 that defines a main passage 426 in fluid communication with a low-pressure air source 188. First annular wall 420 may be a cylinder or may have a radial cross-section defining a non-circular shape, such as an elliptical shape, a racetrack shape, or a polygonal shape (e.g., a rectangular shape). First annular wall 420 may be mounted to outer surface 182 of combustor liner 146. As illustrated, low-pressure air source 188 may include annulus 148 between flow sleeve 144 and combustor liner 146. It is noted that at this location, low-pressure air source 188 collects low-pressure air 186 after impingement cooling of outer surface 182 (FIGS. 2 and 15) of combustor liner 146, i.e., post-impingement air. First annular wall 420 has an upstream end that defines an inlet 422 for low-pressure air 186 and a downstream end that defines an outlet 424 of the fuel nozzle. Inlet 422 may define a bell-mouth shape to facilitate introduction of low-pressure air 186 into main passage 426.

A second annular wall 430 may be disposed radially upstream of inlet 422 of first annular wall 420. In one embodiment, shown in FIG. 14, second annular wall 430 may define a plenum 402 in fluid communication with high-pressure air source 164 via one or more apertures 433 in second annular wall 430. Here, a flow of high-pressure air 180 from high-pressure air source 164 may be directed through one or more apertures 433 in second annular wall 430 to fill plenum 402. In another embodiment, shown in FIG. 15, second annular wall 430 may define plenum 402 by being in direct fluid communication with high-pressure air source 164, i.e., with no circumferentially extending portion in which apertures 433 (FIG. 14) are provided. Here, a flow of high-pressure air 180 from high-pressure air source 164 may be directed directly into second annular wall 430 to fill plenum (space) 402. As noted, high-pressure air 180 has a pressure P1 from high-pressure air source 164 (compressor discharge air) that is greater than low-pressure air 186 pressure P2 from low-pressure air source 188 (post-impingement air). A third annular wall 438 may be nested within plenum 402 and may be surrounded by second annular wall 430. Third annular wall 438 defines a plenum 432 in fluid communication with a fuel source 190.

A mixing conduit 440, which extends through plenum 432, includes an inlet 444 in fluid communication with plenum 402 and an outlet 446 that directs flow into main passage 426 defined by first annular wall 420. One or more injection holes 442 are defined through mixing conduit 440 and are in fluid communication with plenum 432 defined by third annular wall 438. Fuel 192 may flow through the one or more injection holes 442 into a passage 450 defined by mixing conduit 440. Mixing conduit 440 is oriented to direct the flow therethrough in a downstream direction (i.e., toward outlet 424). In this embodiment for second nozzles 172, second annular wall 430, third annular wall 438, and mixing conduit 440 are mounted to an outer surface 437 of flow sleeve 144.

Second fuel nozzle 172 promotes mixing of high-pressure air 180, low-pressure air 186 (from annulus 148), and fuel 192. In operation, high-pressure air 180 from high-pressure air source 164 flows through plenum 402 and into passage 450, while fuel 192 flows through the one or more injection holes 442 into passage 450, creating a premixture of high pressure air 180 and fuel 192. The flow of high-pressure air 180 rapidly carries fuel 192 in a downstream direction into main passage 426 defined by first annular wall 420, where the rapid flow of high-pressure air 180 helps to draw low-pressure air 186 into inlet 422 of main passage 426. Within main passage 426, the premixture of high-pressure air 180 and fuel 192 are mixed with low pressure air 186 to produce a mixture, i.e., a mixed fuel/air stream 460, that exits from outlet 424 of fuel nozzle 172 into combustion region 160, and in particular, secondary combustion zone 110 thereof. Since main passage 426 of second fuel nozzle 172 includes outlet 424 open to combustion region 160 in combustor liner 146, the output of second fuel nozzle 172, i.e., mixed fuel/air stream 460, is directed in a substantially radial direction into combustor liner 146 (and secondary combustion zone 110). Consequently, a combustion reaction occurs within secondary combustion zone 110 of combustor liner 146 with the hot combustion gas stream 129 flowing from primary combustion zone 108, thereby releasing additional heat for the purpose of driving turbine section 120 (FIG. 1) and reducing emissions.

It is noted that FIG. 15 illustrates an alternate placement of second fuel nozzle 172 in can-annular combustor 126 compared to FIG. 2. Namely, fuel nozzle 172 is located on transition piece 128 of combustor liner 146 of combustor 126 instead of in a more upstream portion of combustor liner 146. Second fuel nozzles 172 may be positioned anywhere along a circumference or length of combustor 126 to produce secondary combustion zone 110. Any number of second fuel nozzles 172 may be employed, e.g., in a circumferential array. In a manner similar to that described above, first annular wall 420 may be mounted to transition piece 128, while second annular wall 430, nested third annular wall 438 and mixing conduit 440 are mounted to flow sleeve 144. High-pressure air 180 flowing through mixing conduit 440 (FIG. 14) and into main passage 426 promotes mixing of high-pressure air 180, low-pressure air 186 (from annulus 148), and fuel 192.

With regard to the overall operation of can-annular combustor 126 that includes first and second fuel nozzles 170, 172 (FIG. 2), it is noted that both first and second fuel nozzles 170, 172 produce a premixture of high-pressure air 180 and fuel 192 (and/or 194), and produce a mixture of the premixture (i.e., high-pressure air 180 and fuel 192) and low-pressure air 186, prior to introducing the mixture to a respective primary 108 or secondary combustion zone 110. In this regard, both first and second fuel nozzles promote mixing of high-pressure air 180, low-pressure air 186 (from annulus 148 (FIGS. 2-3) or plenums 387, 389 (FIG. 12)), and fuel 192 prior to introducing the mixture to a respective primary 108 or secondary combustion zone 110.

Operation may also vary based on the type of fuel, e.g., gas fuel 192 and/or liquid fuel 194. As noted, where the fuel includes a gas fuel 192, a flow of high-pressure air 180 passing through mixing conduit 240, 440 entrains the flow of gas fuel 192 from the at least one injection hole 242, 442 to produce the premixture of high-pressure air 180 and gas fuel 192. Mixing conduit 240, 440 conveys the premixture into main passage 226, 426. Within main passage 226, 426, the premixture draws low-pressure air 186 into and through the passage to produce the mixture of the premixture of high-pressure air and gas fuel, and low-pressure air 186.

In an alternative embodiment, the fuel may include liquid fuel 194. In this case, liquid fuel 194 is delivered by fuel source 190 to inlet 222, 422 of main passage 226, 426 in each nozzle 170, 172. In second nozzle 172 (FIG. 14), fuel source 190 may deliver liquid fuel 194 to opening 433 such that it passes through plenum 402 prior to reaching inlet 422, or fuel source 190 may include a conduit (not shown) to deliver liquid fuel 194 through plenum 402 directly to inlet 422. Fuel source 190 may include any form of fuel atomizer to disperse liquid fuel 194. In any event, high-pressure air 180 passing through mixing conduit 240, 440 conveys high-pressure air 180 (and perhaps liquid fuel 194) into main passage 226, 426. Within main passage 226, 426, high-pressure air 180 draws low-pressure air 186 and liquid fuel 194 into and through the passage to produce a mixture of high-pressure air 180, low-pressure air 186 and liquid fuel 194.

In another embodiment, combustor may be a co-fire combustor that uses both gas fuel 192 and liquid fuel 194. Here, fuel source 190 is further configured to deliver gas fuel 192 and deliver liquid fuel 194 to each of first and second fuel nozzles 170, 172. Fuel source 190 may deliver gas fuel 192 to plenums 232, 432, and liquid fuel to inlet 222, 422 of main passage 226, 426, respectively, as described herein.

Embodiments of the disclosure provide a head end assembly 142, 342 providing two different pressure air flows and fuel(s) to a primary combustion zone 108. In addition, embodiments of the disclosure provide a fuel nozzle assembly delivering two different pressure air flows and fuel(s) to a primary combustion zone 108 and a secondary combustion zone 110. Embodiments of the disclosure enable both primary and secondary combustion zones to utilize ejector-type premixing fuel nozzles. The fuel nozzles are fuel-flexible (gas and/or liquid), reduce overall system pressure drop while maintaining required dP/P for cooling, and provide superior premixing to achieve low emissions. This approach also enhances the cooling effectiveness of the available cooling air and thereby lowers the overall system pressure drop. Additionally, this approach enables liquid fuel atomizers to be installed in a breech assembly in head end assembly 142, 342 for easier installation, compactness, faster repair and reduced costs.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A combustor for a gas turbine (GT) system, the combustor comprising:

a combustor liner defining a combustion region including a primary combustion zone and a secondary combustion zone downstream from the primary combustion zone;

a flow sleeve surrounding at least part of the combustor liner, the flow sleeve including a plurality of cooling openings therein to: direct a flow of first air at a first pressure from a first air source to cool an outer surface of the combustor liner, and create a flow of second air at a second, lower pressure than the first pressure in an annulus between the combustor liner and the flow sleeve;

a first fuel nozzle positioned at the primary combustion zone;

a second fuel nozzle positioned at the secondary combustion zone; and a fuel source configured to deliver a first fuel to each of the first and second fuel nozzles, wherein the first and second fuel nozzles produce a premixture of the first air flow and the first fuel, and produce a mixture of the premixture and the second air flow, prior to introducing the mixture to a respective primary or secondary combustion zone.

2. The combustor of claim 1, wherein the first and second fuel nozzles each include:

a first annular wall defining a first passage in fluid communication with the second air flow;

a second wall defining a first plenum in fluid communication with the first air source;

a third wall defining a second plenum in fluid communication with the fuel source to create a flow of the first fuel therein, wherein the third wall is at least partially surrounded by the second wall; and a mixing conduit extending through the second plenum and fluidly connecting the first plenum and the first passage, the mixing conduit defining at least one injection hole in fluid communication with the second plenum.

3. The combustor of claim 2, wherein the first fuel nozzle includes a plurality of first fuel nozzles positioned in a combustor head end assembly defining at least a portion of a head end of the combustion region with the combustor liner, each of the plurality of first fuel nozzles sharing a common first plenum in the combustor head end assembly; wherein each first passage of the plurality of first fuel nozzles includes an outlet open to the combustion region in the combustor liner.

4. The combustor of claim 3, wherein the first air source includes a flow passage defined between a compressor discharge housing and at least a portion of the flow sleeve, the flow passage in fluid communication with a compressor, and further comprising a conduit traversing the annulus to fluidly couple the first plenum with the first air source.

5. The combustor of claim 3, wherein the combustor head end assembly defines a head end plenum with one of: a) the flow sleeve, or b) the flow sleeve and an end cover, wherein the head end plenum receives the second air flow from the annulus, wherein each first passage of the plurality of first fuel nozzles includes an inlet in fluid communication with the head end plenum.

6. The combustor of claim 3, further comprising a fuel manifold fluidly coupling each of the second plenums in the combustor head end assembly to the fuel source, the fuel source being fluidly coupled to the fuel manifold, and wherein the first fuel includes a gas.

7. The combustor of claim 3, wherein the combustor head end assembly is arcuate, and wherein the combustor is an annular combustor in which a plurality of the arcuate combustor head end assemblies collectively form the head end of the combustion region.

8. The combustor of claim 7, wherein the second fuel nozzle is part of an integrated combustor nozzle (ICN).

9. The combustor of claim 3, wherein the combustor head end assembly is substantially circular, and wherein the plurality of first fuel nozzles are arranged in an annular fashion facing into the combustion region.

10. The combustor of claim 9, wherein the plurality of first fuel nozzles are arranged in the combustor head end assembly in a pair of concentric rings facing into the combustion region.

11. The combustor of claim 3, wherein at least one of the plurality of first fuel nozzles has the outlet open to the combustion region in the combustor liner arranged at a non-perpendicular angle relative to the combustor head end assembly.

12. The combustor of claim 2, wherein the first passage of the second fuel nozzle includes an outlet open to the combustion region in the combustor liner such that an output of the second fuel nozzle is directed in a substantially radial direction into the combustor liner.

13. The combustor of claim 2, wherein the first fuel flow includes a gas, and wherein the first air flow passing through the mixing conduit entrains the first fuel flow from the at least one injection hole to produce the premixture of the first air flow and the first fuel; wherein the mixing conduit conveys the premixture into the first passage; and wherein, within the first passage, the premixture draws the second air flow into and through the first passage to produce the mixture of the premixture and the second air flow.

14. The combustor of claim 2, wherein the first fuel includes a liquid and wherein each first passage includes an inlet to which the fuel source delivers the first fuel, and wherein the first air flow passing through the mixing conduit conveys the first air flow into the first passage; and wherein, within the first passage, the first air flow draws the second air flow and a flow of the second fuel into and through the first passage to produce a mixture of the first air flow, the second air flow and the first fuel.

15. The combustor of claim 2, wherein the fuel source is further configured to deliver the first fuel that is a gas and deliver a second fuel that is a liquid, to each of the first and second fuel nozzles, wherein the fuel source delivers the first fuel to the second plenum, and the second fuel to an inlet of the first passage.

16. The combustor of claim 1, the combustor including a combustor head end assembly, the combustor head end assembly including:

a first wall defining a first plenum in fluid communication with a source of a first air at a first pressure; and a plurality of fuel nozzles including each of the first fuel nozzle and the second fuel nozzle extending through the first plenum, each of the plurality of fuel nozzles including:

a first annular wall defining: an inlet at a first side of the first plenum, the inlet open to a source of the second air at the second pressure; an outlet open to the combustion region of the combustor at a second side of the first plenum; and a first passage extending between the inlet and the outlet, wherein the first pressure is greater than the second pressure;

a second plenum in fluid communication with the fuel source, wherein the second plenum is at least partially within the first plenum; and a mixing conduit extending through the second plenum and fluidly connecting the first plenum and the first passage, the mixing conduit defining at least one injection hole in fluid communication with the second plenum.

17. The combustor of claim 16, wherein the first annular wall is configured to mount to the combustor liner of the combustor.

18. The combustor of claim 17, wherein the combustor liner is surrounded by a flow sleeve, defining an annulus between the flow sleeve and the combustor liner, wherein the second air source includes a head end plenum defined by the first side of the first plenum with one of: a) the flow sleeve, or b) the flow sleeve and an end cover, wherein the head end plenum receives the second air from the annulus, and wherein the inlet is in fluid communication with the head end plenum.

19. The combustor of claim 18, the combustor head end assembly further comprising a second passage traversing the annulus and in fluid communication with the first plenum and the first air source.

20. The combustor of claim 19, wherein the first air source includes a flow passage defined between a compressor discharge housing surrounding at least a portion of the combustor liner and the combustor liner, wherein the first air includes a compressor discharge air.

21. The combustor of claim 16, the combustor head end assembly further comprising a fuel manifold fluidly coupling each of the second plenums to the fuel source, the fuel source being fluidly coupled to the fuel manifold, and wherein the fuel includes a gas.

22. The combustor of claim 16, wherein the first plenum is arcuate, and wherein the combustor is an annular combustor in which a plurality of the combustor head end assemblies collectively form a head end of the combustor.

23. The combustor of claim 16, wherein the combustor is a segmented annular combustor in which a plurality of the combustor head end assemblies collectively form a head end of the combustor.

24. The combustor of claim 16, wherein the first plenum is substantially circular, and wherein the combustor is a can combustor.

25. The combustor of claim 16, wherein the plurality of fuel nozzles are arranged in the first plenum in a pair of concentric rings facing into a combustion region of the combustor.

26. The combustor of claim 16, wherein at least one of the plurality of fuel nozzles has the outlet arranged at a non-perpendicular angle relative to the second side of the first plenum at the combustion region of the combustor.

27. The combustor of claim 16, wherein the fuel includes a gas fuel, and wherein a flow of the first air through the mixing conduit entrains a flow of the gas fuel from the at least one injection hole to produce a gas fuel premixture of the first air and the gas fuel; wherein the mixing conduit conveys the gas fuel premixture into the first passage; and wherein, within the first passage, the gas fuel premixture draws a flow of the second air into and through the first passage to produce a mixture of the first air, the gas fuel, and the second air.

28. The combustor of claim 16, wherein the fuel includes a liquid fuel, and wherein a flow of the first air passing through the mixing conduit conveys the first air into the first passage; and wherein, within the first passage, the first air flow draws a flow of the second air and a flow of the liquid fuel into and through the first passage to produce a mixture of the first air, the second air and the liquid fuel.

29. The combustor of claim 16, wherein the fuel includes a gas fuel and a liquid fuel, and wherein a flow of the first air through the mixing conduit entrains a flow of the gas fuel from the at least one injection hole to produce a gas fuel premixture of the first air and the gas fuel; wherein the mixing conduit conveys the gas fuel premixture into the first passage; and wherein, within the first passage, the gas fuel premixture draws a flow of the second air and a flow of the liquid fuel into the inlet and through the first passage to produce a mixture of the first air, the gas fuel, the second air and the liquid fuel.

* * * * *